US009273550B2

(12) United States Patent
Clark

(10) Patent No.: US 9,273,550 B2
(45) Date of Patent: Mar. 1, 2016

(54) SYSTEM AND METHOD FOR DETERMINING FAULT LOCATION

(71) Applicant: INTELLISERV, LLC, Houston, TX (US)

(72) Inventor: Brian Clark, Sugar Land, TX (US)

(73) Assignee: INTELLISERV, LLC, Houston, TX (US)

( * ) Notice: Subject to any disclaimer, the term of this patent is extended or adjusted under 35 U.S.C. 154(b) by 360 days.

(21) Appl. No.: 14/011,868

(22) Filed: Aug. 28, 2013

(65) Prior Publication Data

US 2014/0062715 A1 Mar. 6, 2014

Related U.S. Application Data

(60) Provisional application No. 61/693,932, filed on Aug. 28, 2012.

(51) Int. Cl.

| | |
|---|---|
| ***G01V 3/00*** | (2006.01) |
| ***E21B 47/12*** | (2012.01) |
| ***E21B 17/02*** | (2006.01) |
| *E21B 47/16* | (2006.01) |
| *E21B 47/00* | (2012.01) |

(52) U.S. Cl.

CPC ..... *E21B 47/12* (2013.01); *E21B 17/028* (2013.01); *E21B 47/122* (2013.01); *E21B 47/00* (2013.01); *E21B 47/16* (2013.01)

(58) Field of Classification Search

USPC ..... 340/853.2; 324/500

See application file for complete search history.

(56) References Cited

U.S. PATENT DOCUMENTS

| | | | | |
|---|---|---|---|---|
| 4,707,761 | A * | 11/1987 | Podobinski | H02H 3/445 324/500 |
| 4,820,991 | A | 4/1989 | Clark | |
| 5,343,152 | A * | 8/1994 | Kuckes | G01V 3/24 175/45 |
| 5,682,099 | A * | 10/1997 | Thompson | G01V 3/30 324/338 |
| 5,881,310 | A * | 3/1999 | Airhart | E21B 47/124 710/3 |
| 6,292,541 | B1 * | 9/2001 | Tice | H04B 3/46 324/500 |
| 6,798,211 | B1 | 9/2004 | Rockwell et al. | |
| 6,822,457 | B2 | 11/2004 | Borchert et al. | |

(Continued)

FOREIGN PATENT DOCUMENTS

CN 101639513 A 2/2010

OTHER PUBLICATIONS

PCT/US2013/056992 International Search Report and Written Opinion dated Dec. 6, 2013.

*Primary Examiner* — Jennifer Mehmood
*Assistant Examiner* — Rufus Point
(74) *Attorney, Agent, or Firm* — Conley Rose, P.C.

(57) ABSTRACT

Apparatus and methods for locating faults in inductively coupled wired drill pipe while drilling. In one embodiment, apparatus includes a drill string and a wired drill pipe fault monitor. The drill string includes a plurality of wired drill pipes. Each wired drill pipe includes an inductive coupler at each terminal end. The wired drill pipe fault monitor is coupled to the wired drill pipes. The fault monitor includes an impedance measuring system and a fault locator. The impedance measuring system is configured to measure, while drilling the borehole, an input impedance of the wired drill pipes. The fault locator is configured to determine a propagation constant for the wired drill pipes, and to analyze the measured input impedance and determine, as a function of the measured input impedance and the propagation constant, a location of a fault in the wired drill pipes.

36 Claims, 16 Drawing Sheets

(56) References Cited

U.S. PATENT DOCUMENTS 6,950,034 B2 * 9/2005 Pacault ..... E21B 47/12 340/855.2
7,377,333 B1 * 5/2008 Sugiura ..... E21B 7/06 166/66.5
8,958,604 B2 * 2/2015 Yu ..... E21B 47/12 382/109
2004/0217880 A1 * 11/2004 Clark ..... E21B 47/12 340/854.9
2005/0046591 A1 * 3/2005 Pacault ..... E21B 47/12 340/855.2
2005/0274513 A1 * 12/2005 Schultz ..... E21B 43/04 166/254.2
2008/0099197 A1 * 5/2008 Payne ..... E21B 41/0021 166/250.01
2008/0158005 A1 * 7/2008 Santoso ..... E21B 17/028 340/854.4
2014/0152456 A1 * 6/2014 Olson ..... G01V 3/18 340/853.2

* cited by examiner

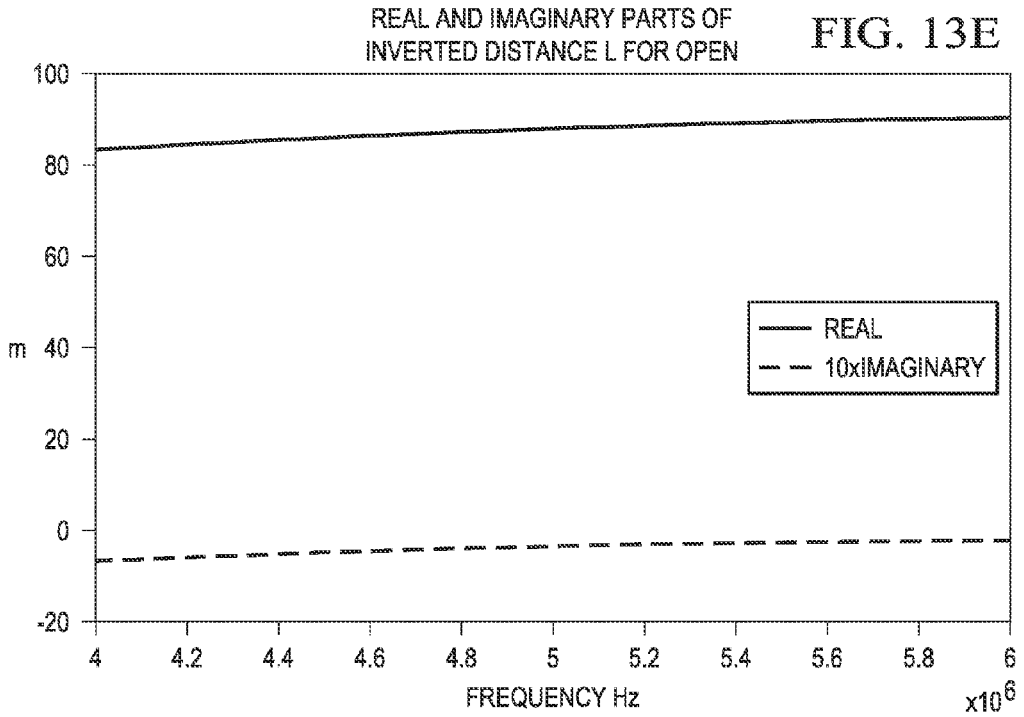
FIG. 13E
FIG. 14
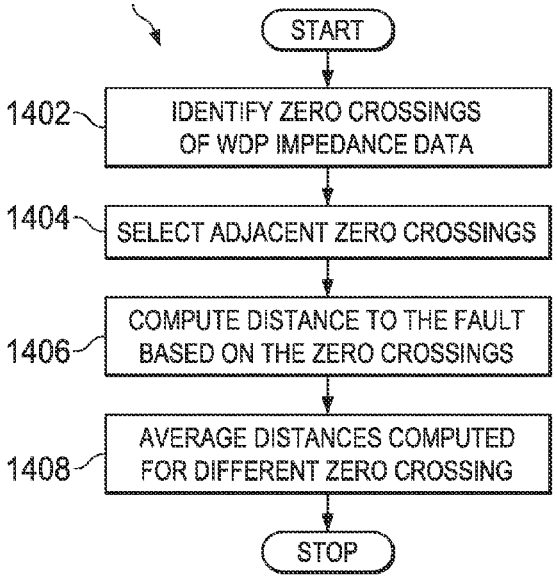
FIG. 15
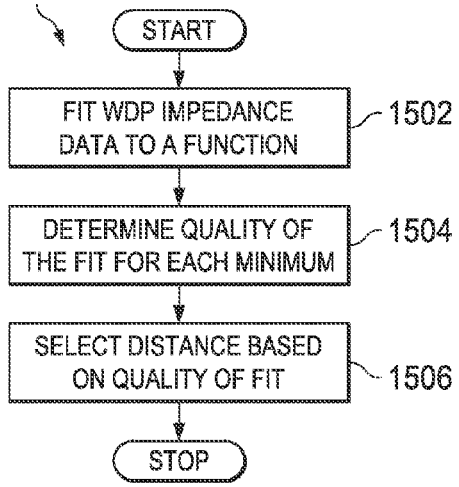

SYSTEM AND METHOD FOR DETERMINING FAULT LOCATION

CROSS-REFERENCE TO RELATED APPLICATION

The present application claims priority to U.S. Provisional Patent Application No. 61/693,932, filed on Aug. 28, 2012, entitled "System and Method for Determining Fault Location," which is hereby incorporated herein by reference in its entirety.

BACKGROUND

While drilling a wellbore in subsurface formations it is advantageous for measurement and command information to be transferred between the surface and the drilling tools in a timely fashion. Some drilling systems employ a high-speed communication network including communication media embedded in the drill pipe to facilitate timely information transfer between surface and downhole systems. Such drill pipe, known as "wired drill pipe" (WDP), includes communicative couplers at each end of each pipe joint and the aforementioned communication media extending between the couplers.

A system employing WDP for communication may include hundreds of individual wired drill pipes connected in series. Repeater subs may be interspersed among the WDPs to extend communication range. If one WDP (or repeater sub) has an electrical fault, then the entire communication system may fail.

In one particularly problematic scenario, an intermittent fault occurs while drilling, but disappears as the drill string is removed from the borehole. Such intermittent faults may be due to downhole pressures, downhole temperatures, shocks, rotating and bending, or other environmental effects that are not present when the drill pipe is retracted from the wellbore. If the fault cannot be traced to within a few joints of WDP, then large sections of WDP may have to be replaced. For example, if the repeater subs are spaced apart by 500 meters, then an intermittent fault may only be locatable to within the 500 meter section below the lowest repeater sub known to be operational. This uncertainty in the location of the fault may require large numbers of WDP joints to be available on the drilling rig. Each failure might require 500 meters of drill pipe to be replaced. If the fault only occurs under drilling conditions, then it may be impossible to identify exactly which drill pipe is failing at the rig site. Therefore, it is desirable to locate an intermittent fault while drilling, that is—while the WDP is in the borehole.

SUMMARY

Apparatus and methods for locating faults in inductively coupled wired drill pipe while drilling are disclosed herein. In one embodiment, apparatus for drilling a borehole in formations includes a drill string and a wired drill pipe fault monitor. The drill string includes a plurality of wired drill pipes. Each wired drill pipe includes an inductive coupler at each terminal end. The wired drill pipe fault monitor is coupled to the wired drill pipes. The fault monitor includes an impedance measuring system and a fault locator. The impedance measuring system is configured to measure, while drilling the borehole, an input impedance of the wired drill pipes. The fault locator is configured to determine a propagation constant for the wired drill pipes, and to analyze the measured input impedance and determine, as a function of the measured input impedance and the propagation constant, a location of a fault in the wired drill pipes.

In another embodiment, a method for locating a fault in wired drill pipe includes disposing a drill string comprising a plurality of wired drill pipes in a borehole. The input impedance of the wire drill pipes is measured while drilling. A first distance to a fault is computed based on the fault being an open circuit. A second distance to the fault is computed based on the fault being a short circuit. Which of the first distance and the second distance provides a best estimate of a true distance to the fault is determined.

In a further embodiment, a method for locating a fault in wired drill pipe includes disposing a drill string comprising a plurality of wired drill pipes in a borehole. The input impedance of the wire drill pipes is measured while drilling. Two adjacent zero crossings in WDP impedance values derived from the measured input impedance are identified. A distance to a fault in the WDP is computed based on the two adjacent zero crossings.

In yet another embodiment, a method for locating a fault in wired drill pipe includes disposing a drill string comprising a plurality of wired drill pipes in a borehole. The input impedance of the wire drill pipes is measured while drilling. WDP impedance values derived from the measured input impedance are fit to an input impedance function. A distance to a fault in the WDP is computed based on a distance value and a reflection coefficient that best fit the WDP impedance values to the input impedance function.

In an additional embodiment, a telemetry system includes a telemetry medium and a fault monitor. The telemetry medium includes a plurality of sections. Each of the sections includes an electrical conductor and an inductive coupler connected to each end of the conductor that inductively couples the section to another of the sections. The fault monitor is coupled to the telemetry medium. The fault monitor includes an impedance measuring system and a fault locator. The impedance measuring system is configured to measure an input impedance of the telemetry medium. The fault locator is configured to: determine a propagation constant for the telemetry medium, to analyze the measured input impedance, and to determine, as a function of the measured input impedance and the propagation constant, a location of a fault in the telemetry medium.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form in the interest of clarity and conciseness.

FIG. 13E shows a plot of distance to the short is the fault is assumed to be an open circuit computed in accordance with principles disclosed herein; and FIGS. 14 and 15 show flow diagrams for methods for determining the distance to a fault in wired drill pipe in accordance with principles disclosed herein.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through direct engagement of the devices or through an indirect connection via other devices and connections. The recitation "based on" means "based at least in part on." Therefore, if X is based on Y, X may be based on Y and any number of other factors.

DETAILED DESCRIPTION

The following discussion is directed to various illustrative embodiments of the invention. The embodiments disclosed are not to be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
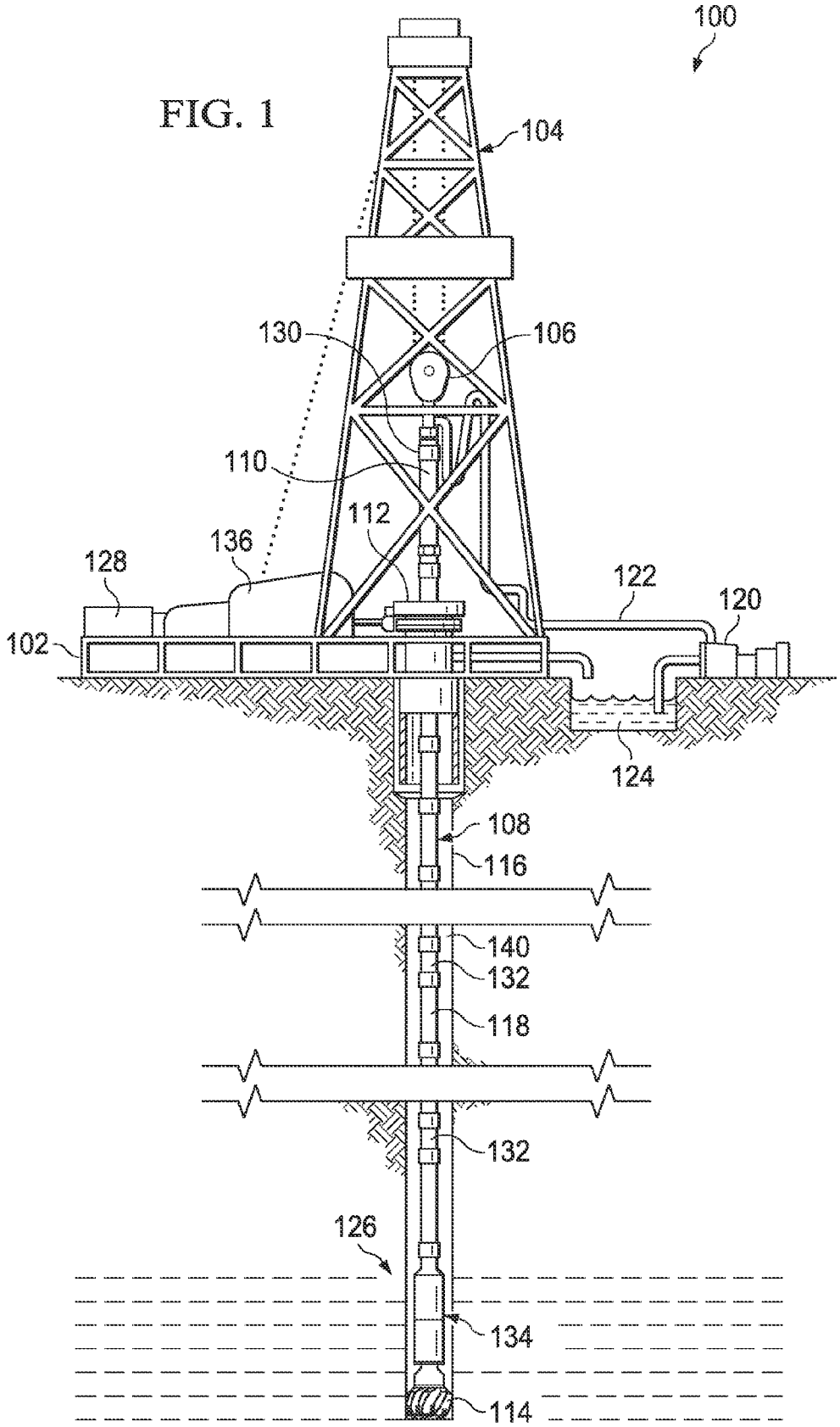
FIG. 1 shows a drilling system that includes wired drill pipe and wired drill pipe fault location in accordance with principles disclosed herein.

FIG. 1 shows a drilling system 100 that includes wired drill pipe (WDP) 118 and wired drill pipe fault location in accordance with principles disclosed herein. In the drilling system 100, a drilling platform 102 supports a derrick 104 having a traveling block 106 for raising and lowering a drill string 108. A kelly 110 supports the drill string 108 as it is lowered through a rotary table 112. In some embodiments, a top drive is used to rotate the drill string 108 in place of the kelly 110 and the rotary table 112. A drill bit 114 is positioned at the downhole end of the tool string 126, and is driven by rotation of the drill string 108 or by a downhole motor (not shown) positioned in the tool string 126 uphole of the drill bit 114. As the bit 114 rotates, it removes material from the various formations 118 and creates the borehole 116. A pump 120 circulates drilling fluid through a feed pipe 122 and downhole through the interior of drill string 108, through orifices in drill bit 114, back to the surface via the annulus 140 around drill string 108, and into a retention pit 124. The drilling fluid transports cuttings from the borehole 116 to the surface and aids in maintaining the integrity of the borehole 116.

The drill string 108 includes a plurality of lengths (or joints) of wired drill pipe 118 that are communicatively coupled end-to-end. A surface sub 130 communicatively couples the wired drill pipes 118 to surface processing systems, such as the drilling control/analysis computer 128. The drill string 108 may also include a bottom hole assembly (BHA) interface 134 and repeater subs 132. The BHA interface 134 communicatively couples the WDPs 118 to the tools of the bottom hole assembly. The repeater subs 132 are interspersed among with the wired drill pipes 118, and may boost and/or regenerate the signals transmitted through the WDPs 118.

The spacing between the repeater subs 132 may be related to the efficiency (i.e. attenuation) of the wired drill pipes 118. The lower the attenuation, the greater the distance (e.g., the number of joints of WDP 118) between the repeater subs 132. Repeater subs 132 may be individually addressable, so that a command can be sent from the surface computer 128 to a selected repeater sub 132. In response to the command, the selected repeater sub 132 may transmit an acknowledgement to the surface computer 128. Such individual addressability and command/response protocol can be used to verify that the WDPs 118 and associated repeaters 132 (i.e., the WDP system) are working correctly between the surface computer 128 and the selected repeater sub 132.

Figure 2:
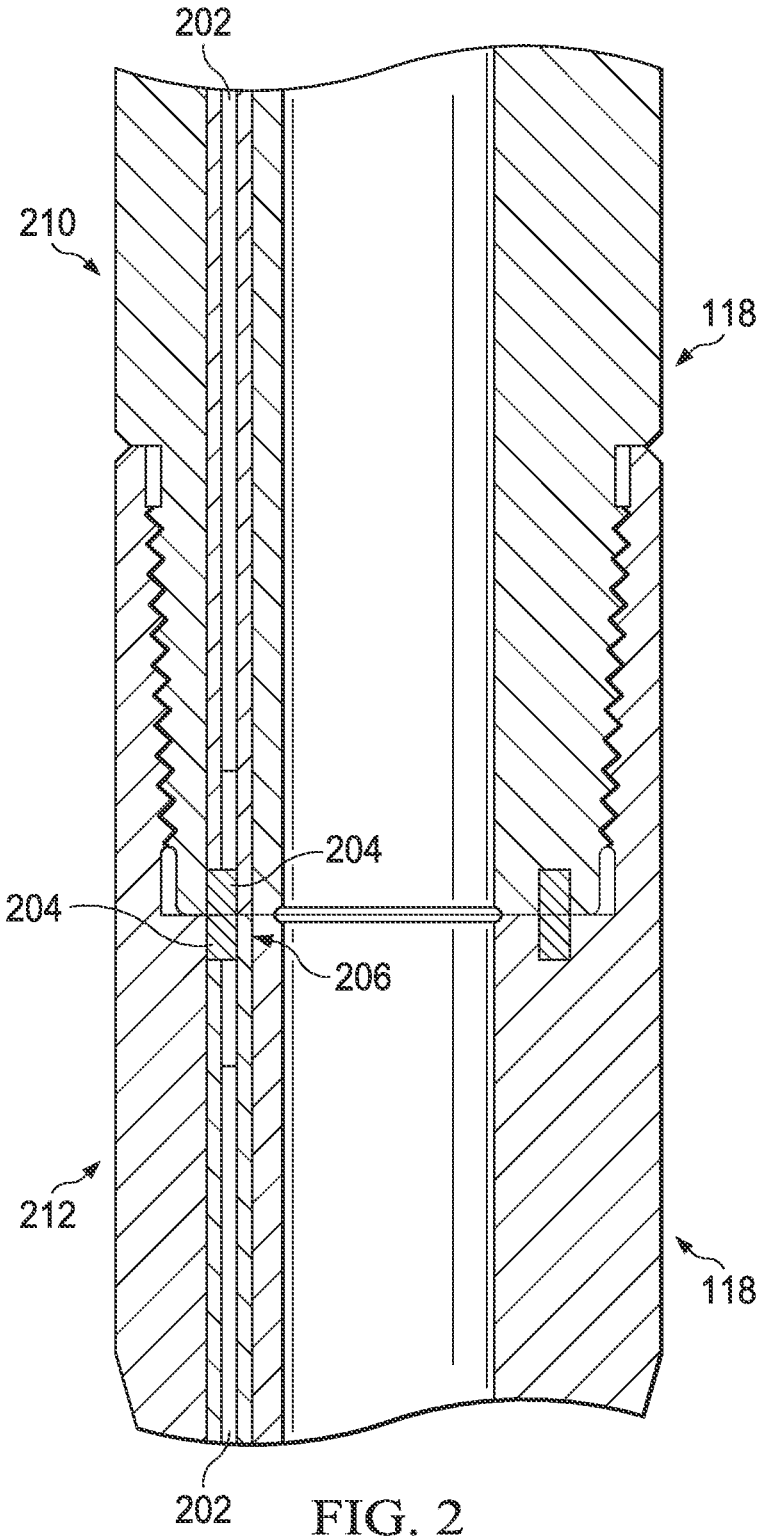
FIG. 2 shows a longitudinal cross-section of an inductively coupled pair of wired drill pipes in accordance with principles disclosed herein.

FIG. 2 shows a longitudinal cross-section of a mated pair of wired drill pipes 118 (or a sub 130, 132, 134 and a WDP 118) in accordance with principles disclosed herein. Each WDP 118 includes a communicative medium 202 (e.g., a coaxial cable, twisted pair, etc.) structurally incorporated or embedded over the length of the pipe 118, and an interface 206 at each end of the pipe 118 for communicating with an adjacent WDP 118, sub, or other component. The communicative medium 202 is connected to each interface 206. In some embodiments, the interface 206 may include an inductive coupler 204 (e.g., an annular inductive coupler) for forming a communicative connection with the adjacent component. The inductive coupler 204 may be embedded in insulating material, and may include a coil and magnetically permeable material, a toroid and conductive shell, etc. For example, FIG. 2 shows a pin end 210 of a first wired drill pipe 118 mated to a box end 212 of a second wired drill pipe 118 such that inductive couplers 204 of the wired drill pipes 118 connect the cables 202 of the two wired drill pipes 118. The high bandwidth of the wired drill pipes 118 allows for transfers of large quantities of data at a high transfer rate.

Figure 3A:
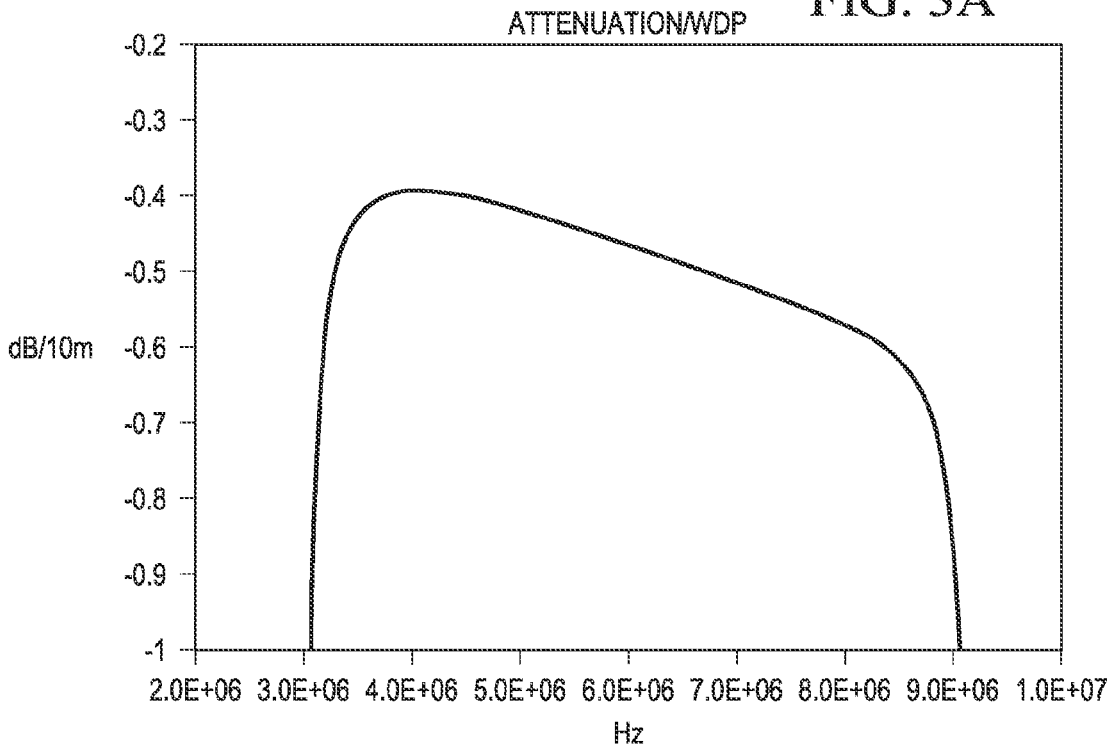
FIGS. 3A-3C show characteristics of inductively coupled wire drill pipes.
Figure 3B:
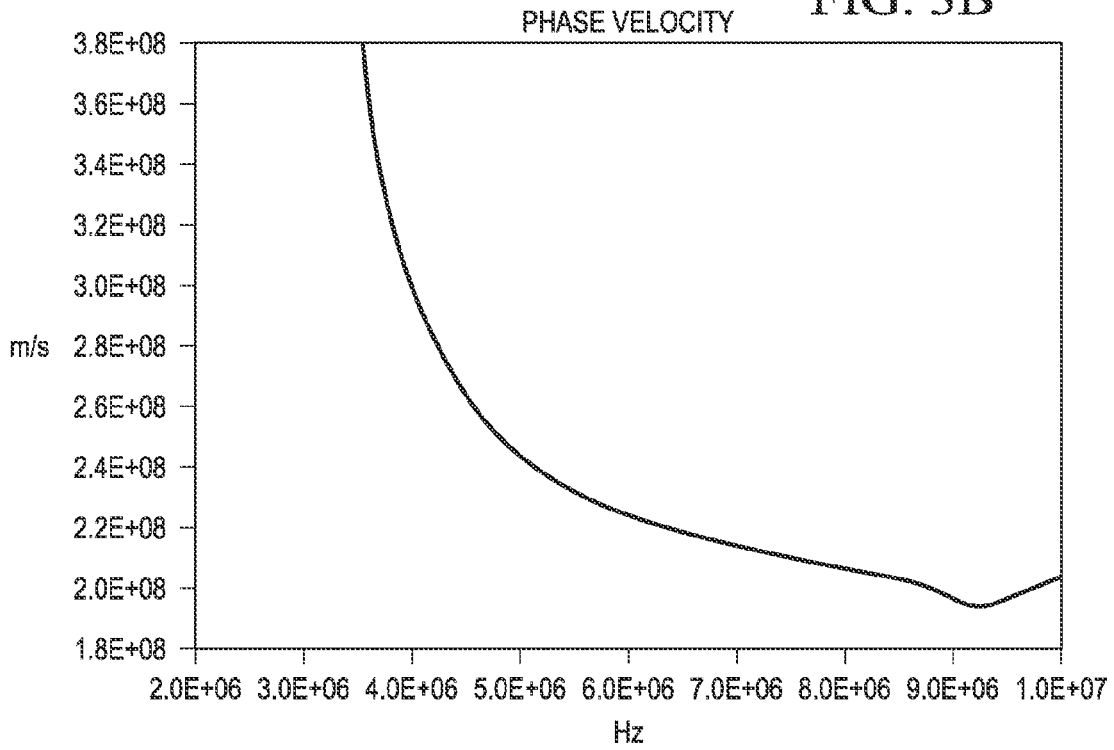
Figure 3C:
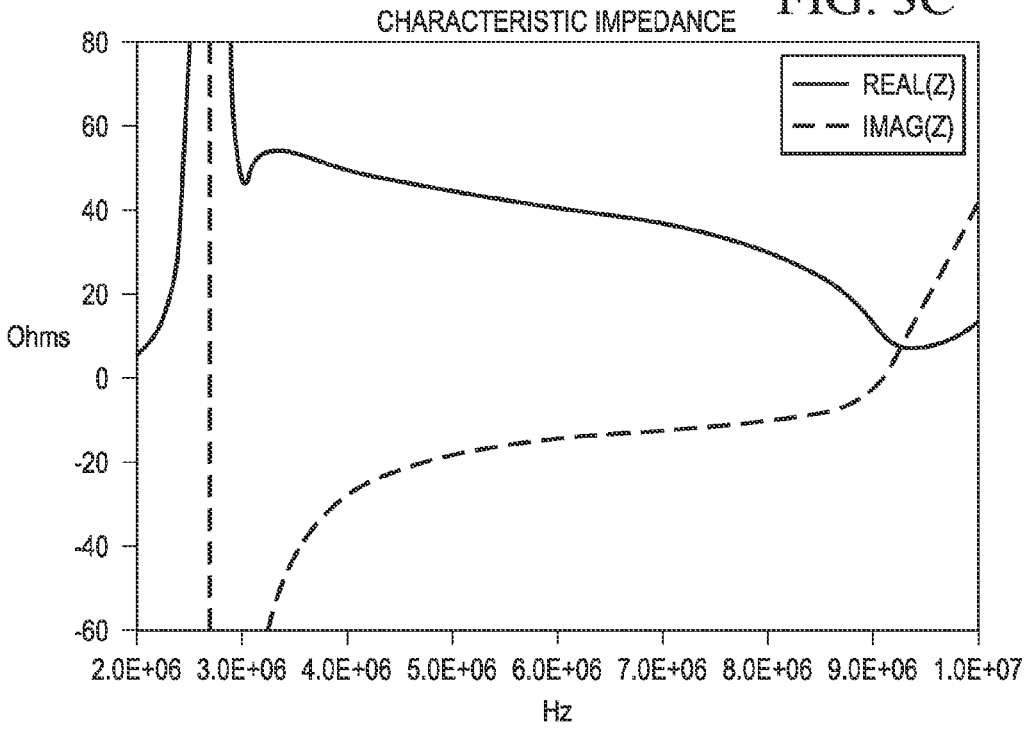

The inductive couplers 204 that connect one joint of WDP 118 to another limit the bandwidth of WDP telemetry to lower and upper cut-off frequencies that depend on the properties of the inductive couplers 204 and on the cable 202 which runs through the WDP 118. One example of inductively coupled WDP is "INTELLISERV NETWORKED DRILL PIPE" produced by NOV INTELLISERV. The electrical properties of inductively coupled WDP are more complex than a WDP system employing electric contacts (e.g., conductive contacts). For example, FIG. 3A shows the attenuation per 10 meter WDP. The maximum operating frequency range is approximately 4 MHz to 8 MHz. Outside of this frequency range, there is very high attenuation. FIG. 3B shows that the phase velocity varies rapidly with frequency. FIG. 3C shows that the characteristic impedance has real and imaginary parts that vary with frequency. Embodiments disclosed herein are applicable to any inductively coupled WDP and to any system that is bandwidth limited with lower and upper cut-off frequencies.

Embodiments of the WDP fault monitoring system disclosed herein are configured to locate the position of an intermittent failure or a permanent failure in the WDPs 118. Common failure modes for WDPs 118 include an open circuit and a short circuit. An open circuit may be due to a break in the cable 202, or a bad connection between the cable 202 and the inductive coupler 204. An open circuit is represented by a high equivalent load impedance (e.g., thousands of ohms). A short circuit may be due to mechanical failure of the insulation between the inductive coupler 204 and the drill pipe 118, a mechanical failure of the connection between the inductive coupler 204 and the cable 202, or by a pinched wire. A short circuit is represented by a low equivalent load impedance (e.g., zero ohms). Such hard failures may be induced by harsh downhole conditions. An intermittent open circuit caused by shock is a common type of fault in the WDPs 118.

Figure 4:
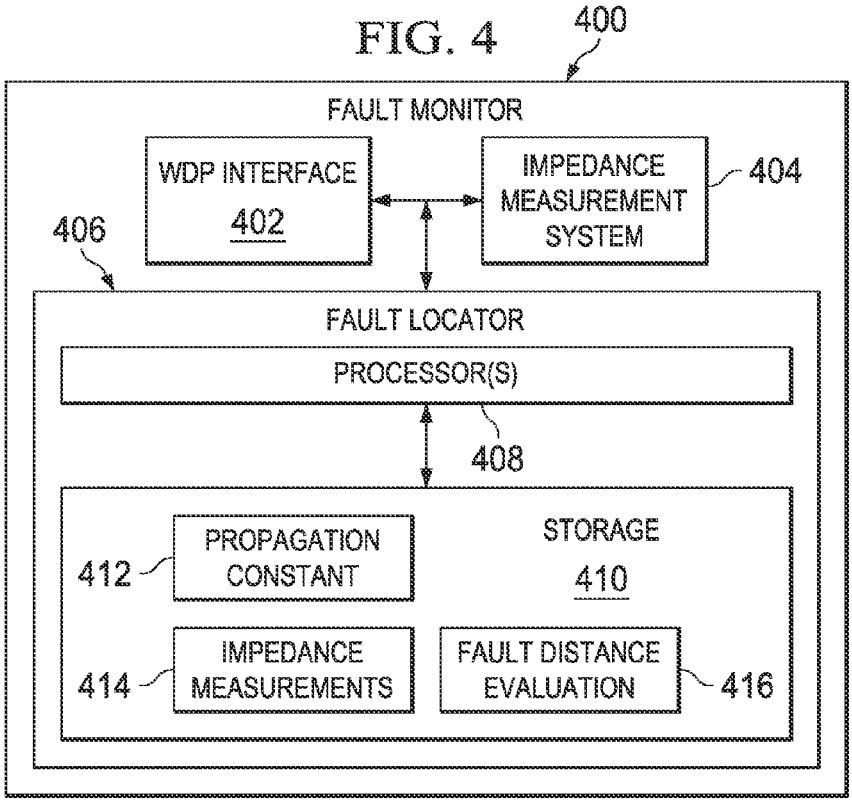
FIG. 4 shows a block diagram of a wired drill pipe fault monitoring system in accordance with principles disclosed herein.

Embodiments of the drilling system 100 are configured to precisely locate faults in the wired drill pipes 118 of the drill string 108. FIG. 4 shows a block diagram of a wired drill pipe fault monitoring system 400 in accordance with principles disclosed herein. The fault monitor 400 may be disposed in whole or in part in the repeaters subs 132, the surface sub 130, and/or the BHA interface 134 for locating faults in the joints of wired drill pipes 118 uphole or downhole of the fault monitor 400. In some embodiments, the surface computer 128 may implement a portion of the fault monitor 400. Because at least some portion of the fault monitor 400 may be replicated in the repeater subs 132, the BHA interface 134 and the surface sub 130, embodiments of the drilling system 100 can locate a fault in wired drill pipes 118 from two directions (i.e., from uphole and downhole of the fault), thereby improving fault location accuracy. Embodiments of the fault monitoring system 400 locate a fault to within a few drill pipes 118. Thus, embodiments require that only a few drill pipes be replaced in the drill string 108, thereby reducing the time and expense associated with correcting a fault in the wired drill pipe 118.

The fault monitor 400 includes WDP interface 402, impedance measurement system 404, and fault locator 406. The WDP interface 402 connects the impedance measurement system 404 to the cable 202 and/or the inductive coupler 204 of the sub including the fault monitor 400 (e.g., the repeater sub 132). In some embodiments, the WDP interface 402 may selectively and/or periodically connect the impedance measurement system 404 to the cable 202 and/or the inductive couplers 204 via, for example, switches or relays. In other embodiments, the WDP interface 402 may fixedly connect the impedance measurement system 404 to the cable 202 and/or the inductive couplers 204.

Figure 5:
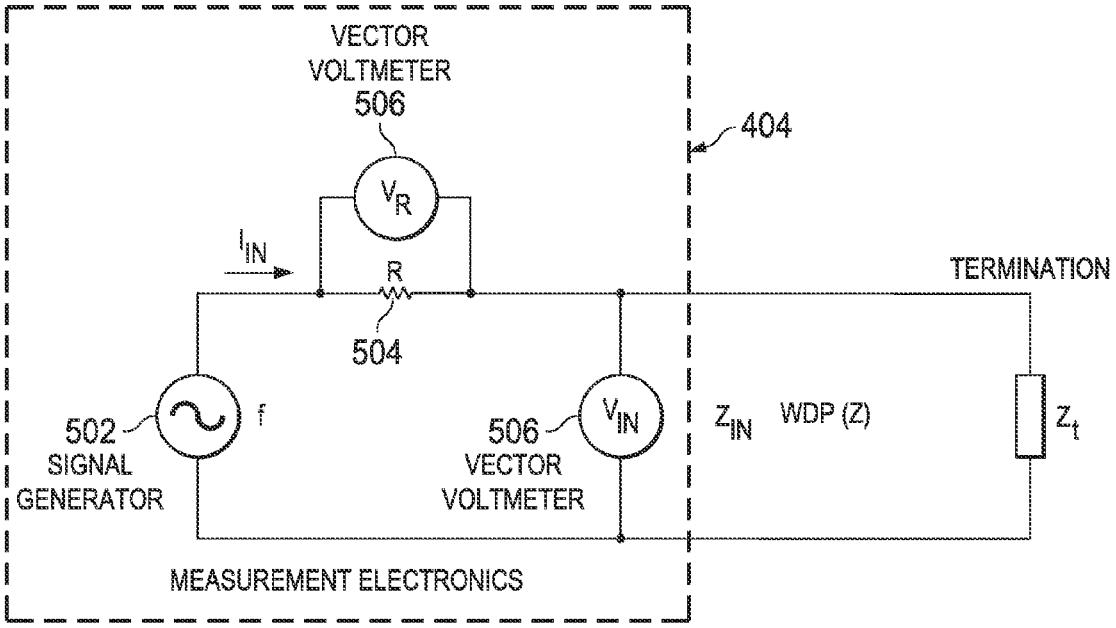
FIG. 5 shows a schematic diagram of a wired drill pipe impedance measurement system in accordance with principles disclosed herein.

The impedance measurement system 404 includes electronic circuitry that measures the impedance of a section of wired drill pipes 118 connected to, and either uphole or downhole of, the fault monitor 400. FIG. 5 shows a schematic diagram of a wired drill pipe impedance measurement system 404 in accordance with principles disclosed herein. Other electronic systems for measuring impedance are known in the art, and the impedance measurement system 404 encompasses all such systems. The illustrated embodiment of WDP impedance measurement system 404 includes a signal generator 502, a resistor 504, and one or more vector voltmeters 506.

The signal generator 502 produces an oscillating signal of frequency f, and angular frequency $\omega=2\pi f$. The signal generator 502 may produce frequencies over the entire transmission bandwidth of the WDPs 118. The section of WDPs 118 driven by the impedance measurement system 404 has a characteristic impedance $Z(\omega)$, and is terminated by a load impedance $Z_t(\omega)$. The impedance measurement system 404 determines the amplitude and phase of the current, $I_{IN}(\omega)$, injected into the WDPs 118 from the voltage $V_R$ across the resistor 504 (R), using $I_{IN}(\omega)=V_R(\omega)/R$. The voltage input to the WDP section is $V_{IN}$. Both $V_R$ and $V_{IN}$ may be measured using the vector voltmeters 506, which provide both amplitude and phase information. The WDP input impedance can be obtained from:

$$Z_{IN}(\omega)=V_{IN}(\omega)/I_{IN}(\omega) \quad (1)$$

When the measured section of WDPs 118 (e.g., the WDPs 118 between two repeaters 132) is terminated by a load with the same impedance as the WDP characteristic impedance, i.e., $Z_t(\omega)=Z(\omega)$, the input impedance is given by $Z_{IN}(\omega)=Z(\omega)$. Hence, when the WDP system is operating correctly, the WDP impedance $Z(\omega)$ is obtained from measuring $Z_{IN}(\omega)$ with the impedance measurement system 404.

The fault monitor 400 may measure $Z_{IN}(\omega)$ periodically during drilling for at least two reasons. First, if the input impedance is unchanged and equal to that expected for WDPs 118, then the WDP system is functioning correctly. Accordingly, the values of $Z_{IN}(\omega)$ should be recorded over the telemetry bandwidth for future reference. Second, if the input impedance begins to significantly change, then the properties of the WDP system are being adversely affected by downhole conditions. Such change in impedance is an indication of a developing problem. If the telemetry signal becomes noisy, is intermittent, or fails altogether, then there is a fault somewhere in the WDPs 118.

The fault locator 406 collects the impedance measurements provided by the impedance measurement system 404, determines, based on the measurements and other indications of telemetry problems (e.g., discontinuation of communication with other repeater subs, etc.), whether a fault is present in the section of WDPs 118 adjacent to the fault monitor 400, and determines a location of the fault. The fault locator 406 includes processor(s) 408 and storage 410. The processor(s) 408 may include, for example, one or more general-purpose microprocessors, digital signal processors, microcontrollers, or other suitable instruction execution devices known in the art. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The storage 410 is a non-transitory computer-readable storage device and includes volatile storage such as random access memory, non-volatile storage (e.g., a hard drive, an optical storage device (e.g., CD or DVD), FLASH storage, read-only-memory), or combinations thereof. The storage 410 includes impedance measurements 414, propagation constant logic 412, fault distance evaluation logic 416, and various data processed by and produced by the processor(s) 104. The impedance measurements 414 include WDP impedance values generated by the impedance measurement system 404. The propagation constant logic 412 includes instructions for determining a propagation constant value useable for determining the location of a fault in the WDPs 118, and propagation constant values associated with the WDPs 118. The fault distance evaluation logic 416 includes instructions for determining a distance from the fault monitor 400 to a fault in the WDPs 118 based on the impedance measurements and the propagation constant. Processors execute software instructions. Software instructions alone are incapable of performing a function. Therefore, any reference herein to a function performed by software instructions, or to software instructions performing a function is simply a shorthand means for stating that the function is performed by a processor executing the instructions.

Figure 6:
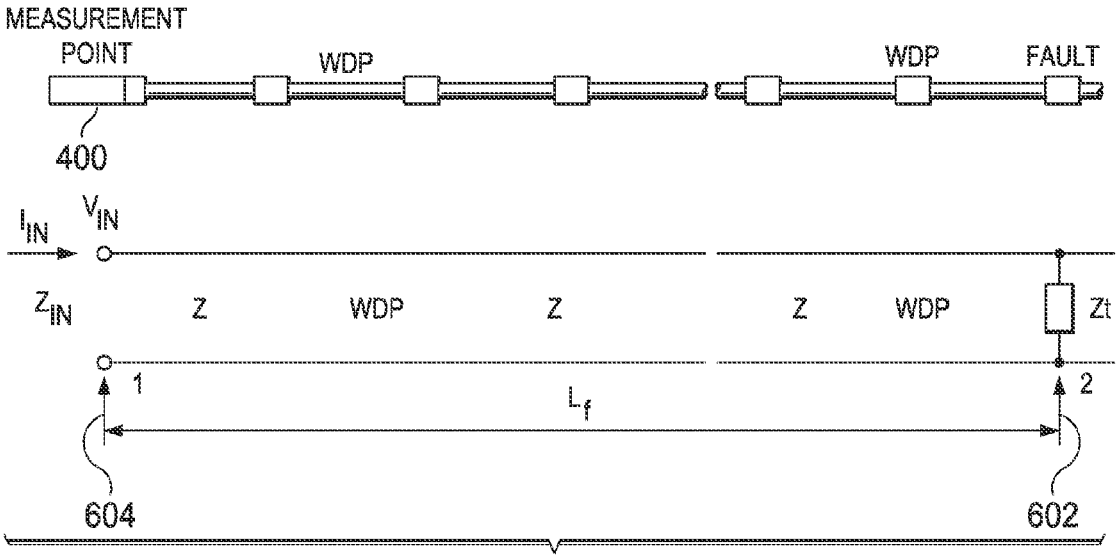
FIG. 6 shows a transmission line model of wired drill pipe in accordance with principles disclosed herein.

FIG. 6 shows a transmission line model of wired drill pipes 118 in accordance with principles disclosed herein. If a fault develops at a point 602 at distance $L_f$ from a measurement point 604 (e.g., the location of fault monitor 400). The fault can be represented as a terminating impedance, $Z_t$, on the section of WDP 118 transmission line. (Note that while explicit dependence on angular frequency (ω) is not always stated herein, it is understood that the impedances are functions of frequency). If the fault is an open circuit, then $Z_t >> Z$. If the fault is a short circuit, then $Z_t = 0$. The reflection coefficient at the location of the fault 602 is:

$$\Gamma \equiv \frac{Z_t - Z}{Z_t + Z} \tag{2}$$

Three special cases are of particular interest: $\Gamma=0$ if $Z_t=Z$, $\Gamma=-1$ if $Z_t=0$, and $\Gamma=1$ if $Z_t>>Z$. The input impedance at location 604 in FIG. 6 is given by:

$$Z_{IN}(\omega) = Z(\omega)\frac{1+\Gamma\exp(-2\gamma(\omega)L_f)}{1-\Gamma\exp(-2\gamma(\omega)L_f)} \tag{3}$$

where $\gamma(\omega)=\alpha(\omega)+j\beta(\omega)$ is the complex propagation constant for WDPs 118. The real part of the propagation constant $\alpha(\omega)$ is related to the attenuation by:

$$Atten = 8.686\alpha, \tag{4}$$

and the imaginary part $\beta(\omega)$ is related to the phase velocity $V_P(\omega)$ and angular frequency by:

$$V_P = \frac{\omega}{\beta} \tag{5}$$

or by:

$$\beta = \omega / V_P(\omega). \tag{6}$$

Figure 7A:
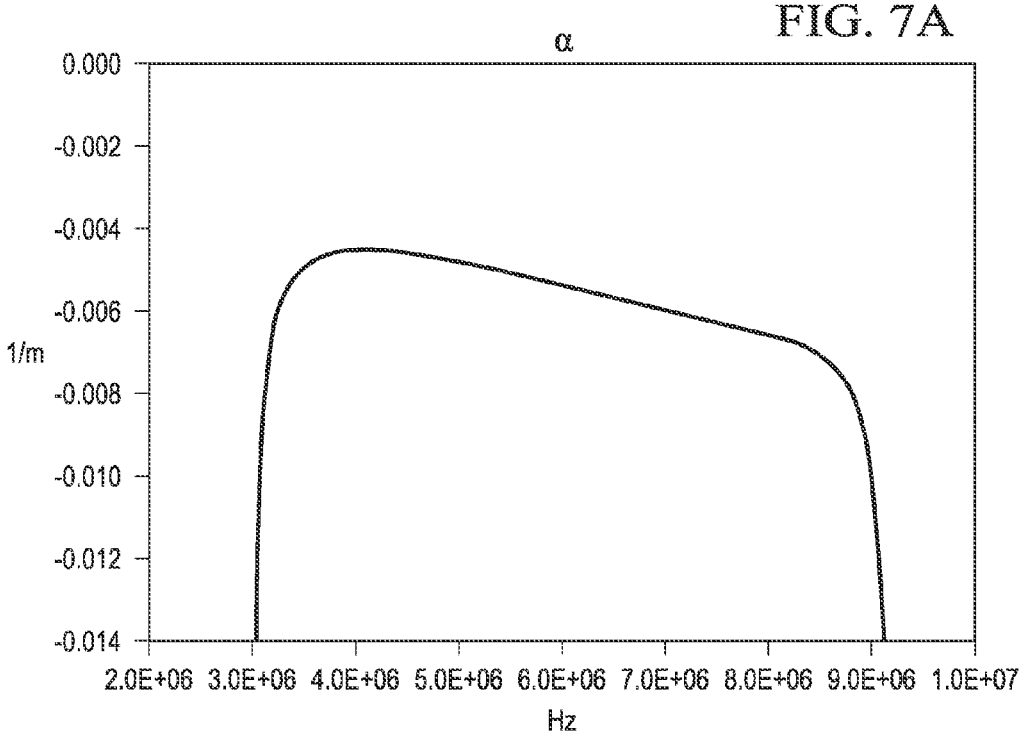
FIGS. 7A and 7B show plots of real and imaginary parts of complex propagation constant.
Figure 7B:
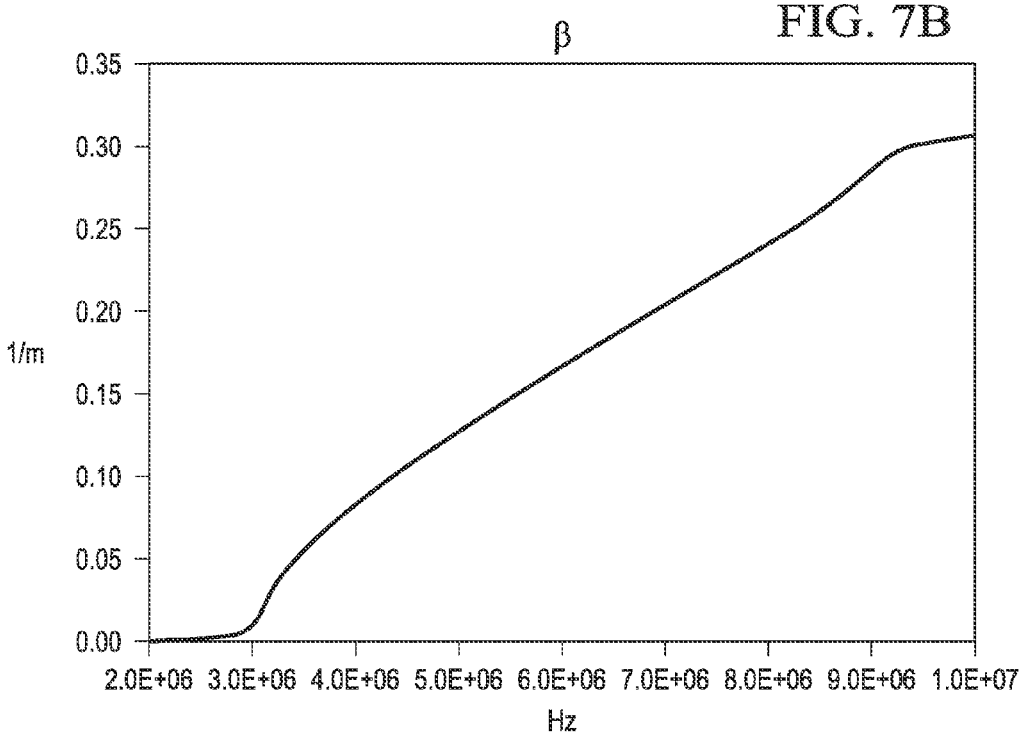

In general, both $\alpha(\omega)$ and $\beta(\omega)$ are functions of angular frequency ω. FIGS. 7A and 7B are plots of $\alpha(\omega)$ and $\beta(\omega)$ corresponding to FIGS. 3A and 3B. The real and imaginary parts of the propagation constant $\gamma(\omega)$ can be determined in a variety of ways, and the present disclosure encompasses all means of determining the propagation constant. The present disclosure describes below how $\gamma(\omega)$ can be accurately measured for a WDP system. The fault monitor 400 determines $\gamma(\omega)$ as a function of frequency.

The normalized input impedance measured by the fault monitor 400 at point 604 is defined as:

$$\begin{aligned}\zeta(\omega) &= \zeta'(\omega) + j\zeta''(\omega) \\ &= \frac{Z_{IN}(\omega)}{Z(\omega)} \\ &= \frac{1+\Gamma\exp(-2\gamma(\omega)L_f)}{1-\Gamma\exp(-2\gamma(\omega)L_f)}.\end{aligned} \tag{7}$$

When the fault monitor 400 detects a fault in WDPs 118, the nature of the fault (whether it is an open, a short, or some other in-between value) and the location of the fault are unknown. The propagation constant $\gamma(\omega)$, the WDP characteristic impedance $Z(\omega)$ (from measurements before the fault occurs), and the input impedance $Z_{IN}(\omega)$ (from measurements after the fault has occurred) are known. The normalized input impedance $\zeta(\omega)=Z_{IN}(\omega)/Z(\omega)$ is also known. These known quantities are complex numbers, and they are functions of frequency, but the distance $L_f$ to the fault is a real number and is not a function of frequency. Consequently, the inversion process should not result in a distance that has an imaginary component, nor should the distance be a function of frequency. In addition, if the fault is either an open or a short, then the reflection coefficient Γ will be mostly real (possibly with a very small imaginary part), and Γ should not be a strong function of frequency.

Figure 8A:
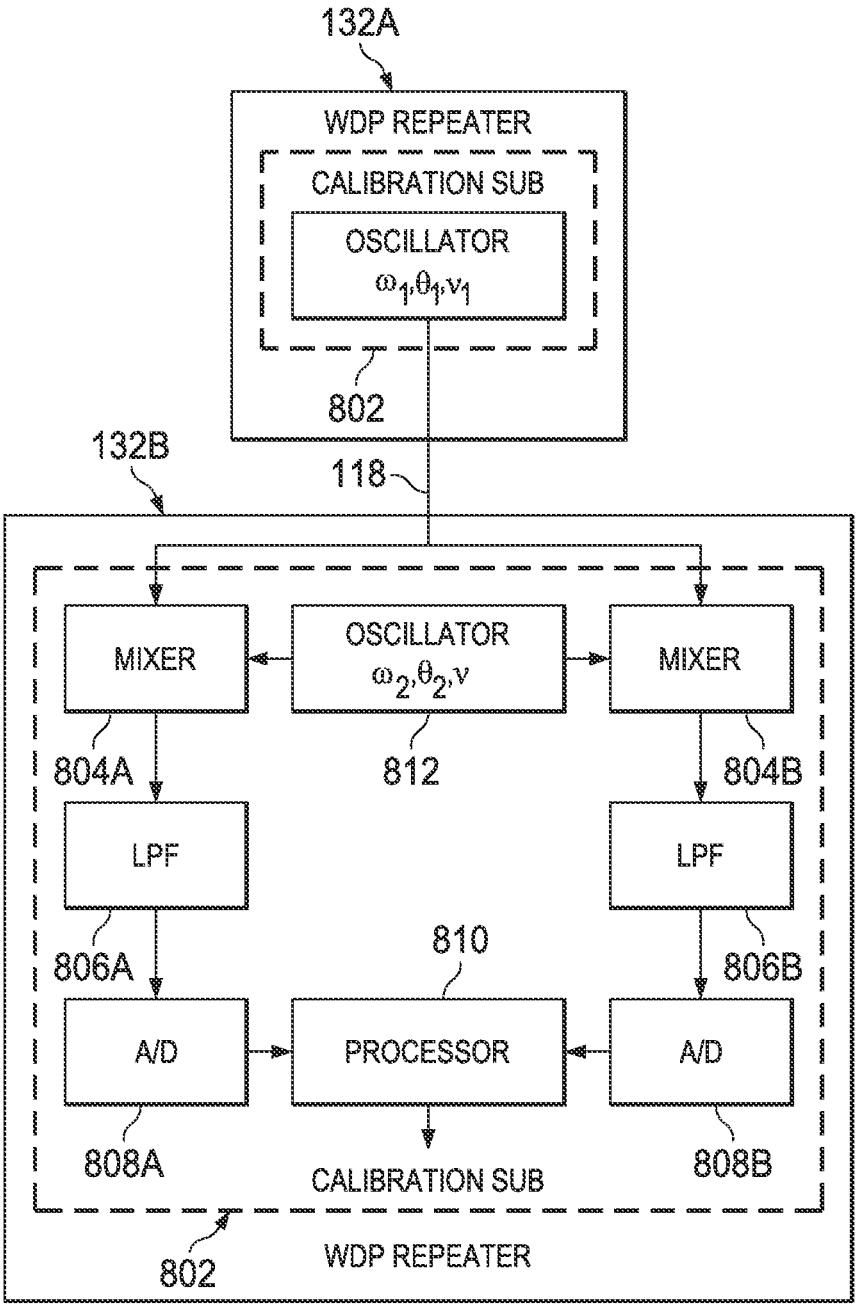
FIGS. 8A and 8B show a block diagrams of a channel characterization system including a pair of repeater subs configured to determine the propagation constant of wired drill pipe connecting the repeater subs in accordance with various embodiments.
Figure 8B:
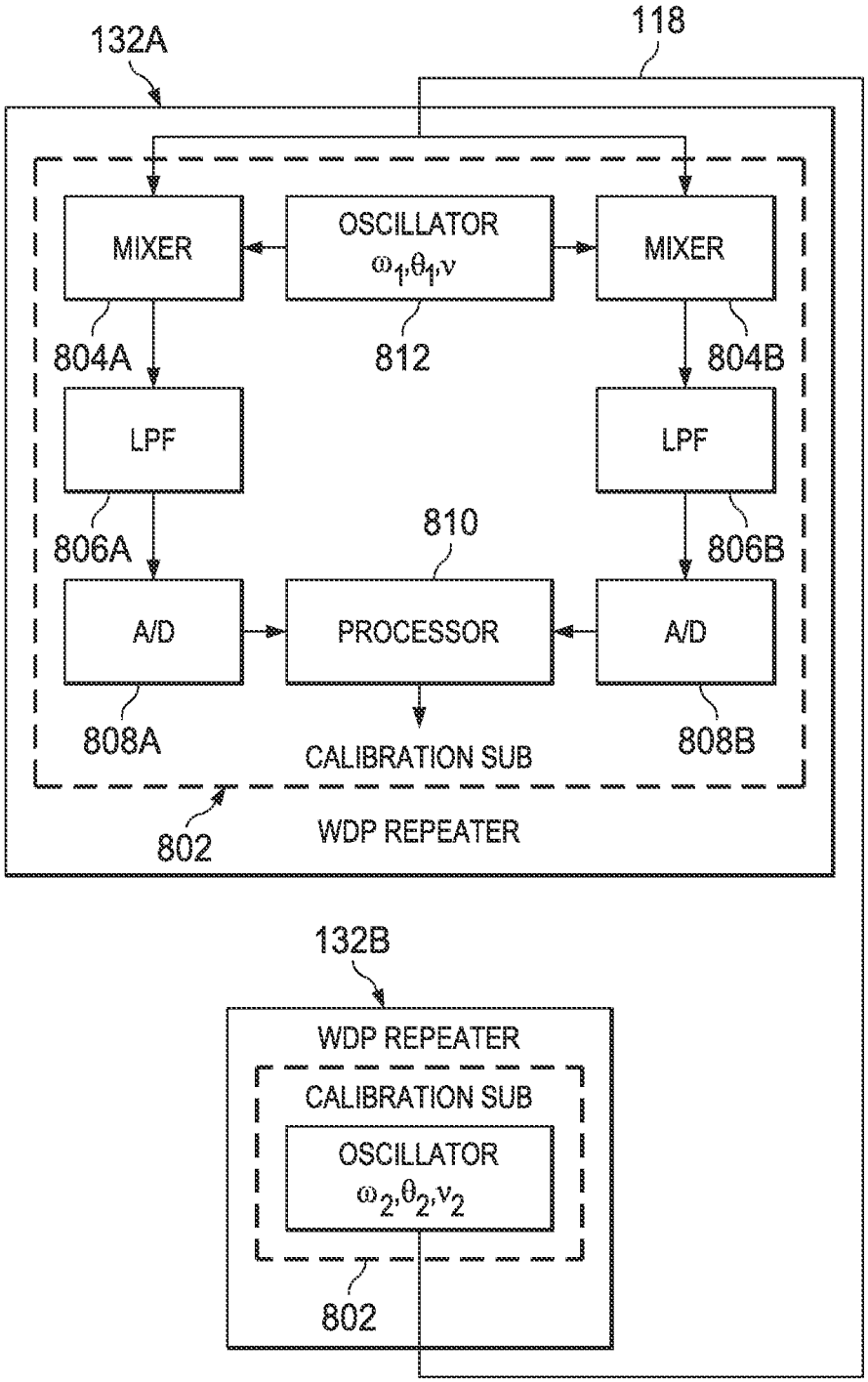

FIGS. 8A and 8B show block diagrams of a pair of repeaters subs 132 (132A, 132B) configured to determine the propagation constant of the WDP 118 disposed between the repeater subs 132. That is, the repeater subs 132A, 132B include calibration subs 802, the blocks of which are shown in FIGS. 8A and 8B. Because the present technique for determination of the propagation constant includes transmission of sinusoidal signals from each the repeaters subs 132A, 132B to the other, the repeater subs 132A, 132B may include similar circuitry. In FIG. 8A, repeater sub 132A transmits sinusoidal signal to repeater sub 132B via WDP(s) 118, consequently, only a portion of the circuitry of repeater sub 132A is shown. Repeater sub 132B processes the received sinusoidal signal and produces information that can be used to determine channel parameters.

Each repeater sub 132A, 132B includes an oscillator 812, mixers 804 (804A, 804B), low pass filters 806 (806A, 806B), analog-to-digital converters 808 (808A, 808B), and a processor 810. In some embodiments, a single filter 806, digitizer 808, or other component may be shared by the two signal paths. The processor 810 may be remote from a repeater sub 132A, 132B in some embodiments. For example, the processor 810 may be disposed at the surface, and WDP channel characterization information may be transmitted to processor 810 at the surface by the repeater subs 132A, 132B via WDP telemetry. In some embodiments, the processor 810 may be included in the processor(s) 408.

The oscillator 812 provides a stable frequency source that allows the repeater sub 132A, 132B to generate a sinusoidal signal at frequencies of interest over the WDP transmission channel. In some embodiments, the oscillator 812 may be a dual-mode quartz oscillator suitable for downhole operation. Such oscillators may be accurate to 0.1 parts-per-million (ppm) and have a resolution of 0.2 ppb, and be qualified to 185° Celsius. Some embodiments may apply software correction to achieve even higher oscillator accuracy (e.g., 10 ppb to 40 ppb).

Characterization of the WDP channel between the repeater subs 132A, 132B includes measuring the propagation constant $\gamma(\omega)=\alpha(\omega)+j\beta(\omega)$ at a number of frequencies of interest over the bandwidth of the WDP channel. The imaginary part of $\gamma(\omega)$ is related to the phase velocity $V_P$ via equation (6). The group velocity can be determined by measuring $\beta$ at adjacent angular frequencies $(\omega,\omega+d\omega)$ and computing $$V_G \approx \frac{d\omega}{\beta(\omega+d\omega)-\beta(\omega)}. \tag{1}$$

In the arrangement of FIG. 8A, repeater sub 132A generates a signal $V_1 \sin(\omega_1 t+\theta_1)$, where $V_1$ is a known voltage. For example, a voltmeter in the repeater sub 132A can measure the voltage $V_1$. The angular frequency $\omega_1$ of the oscillator 812 is also known to a given accuracy. In some embodiments, the repeater sub 132A receives, via WDP telemetry, voltage and frequency parameters to apply in generating the signal, from a parameter source at the surface for example. If sub 132A is uphole of sub 132B and the distance between the subs 132A, 132B is x with sub 132A located at x=0 and sub 132B located at x=L, then the downward propagating wave at any location x along the WDP 118 at time t is described by $V_1 e^{-\alpha x} \sin(\omega_1 t-\beta x+\theta_1)$. The repeater subs 132A, 132B may be sufficiently well matched to the WDP transmission line impedance that there are only negligible reflections.

The repeater sub 132B is configured to receive the signal transmitted by the sub 132A. The frequency of the oscillator 812 of the sub 132B is set to an angular frequency $\omega_2$. Preferably, $\omega_2=\omega_1$, but there may be a small angular frequency difference $\Delta\omega=\omega_1-\omega_2$ where $\Delta\omega \ll \omega_1,\omega_2$. The signal received at the repeater sub 132B is $V_1 e^{-\alpha L} \sin(\omega_1 t-\beta L+\theta_1)$. The repeater sub 132B splits the received signal into two equal signals $$\frac{1}{2}V_1 e^{-\alpha L}\sin(\omega_1 t-\beta L+\theta_1)$$

and provides one of the two signals to each of the mixers 804A, 804B. The oscillator 812 of the sub 132B provides mixer 804A with a signal $V \sin(\omega_2 t+\theta_2)$, and provides mixer 804B with a signal $V \cos(\omega_2 t+\theta_2)$. Mixer 804A mixes $$\frac{1}{2}V_1 e^{-\alpha L}\sin(\omega_1 t-\beta L+\theta_1)$$

and $V \sin(\omega_2 t+\theta_2)$ producing:

$$\rho_1(t)=\frac{1}{2}V_1 e^{-\alpha L}\sin(\omega_1 t-\beta L+\theta_1)\sin(\omega_2 t+\theta_2), \tag{2}$$

$$\rho_1(t)=\frac{1}{4}V_1 e^{-\alpha L}\{\cos[(\omega_1-\omega_2)t-\beta L+\theta_1-\theta_2]-\cos[(\omega_1+\omega_2)t-\beta L+\theta_1+\theta_2]\}. \tag{3}$$

For simplicity, set V=1 volt.

The output of mixer 804A is provided to the low pass filter 806A. The low pass filter 806A blocks the high frequency term $\omega_1+\omega_2$ and passes the low frequency term $\Delta\omega=\omega_1-\omega_2$, producing signal:

$$\rho_2(t)=\frac{1}{4}V_1 e^{-\alpha L}\cos(\Delta\omega t-\beta L+\theta_1-\theta_2) \tag{4}$$

Mixer 804B mixes $$\frac{1}{2}V_1 e^{-\alpha L}\sin(\omega_1 t-\beta L+\theta_1)$$

and $V \cos(\omega_1 t+\theta_2)$ producing:

$$\sigma_1(t)=\frac{1}{2}V_1 e^{-\alpha L}\sin(\omega_1 t-\beta L+\theta_1)\cos(\omega_2 t+\theta_2), \tag{5}$$

$$\sigma_1(t)=\frac{1}{4}V_1 e^{-\alpha L}\{\sin[(\omega_1-\omega_2)t-\beta L+\theta_1-\theta_2]+\sin[(\omega_1+\omega_2)t-\beta L+\theta_1+\theta_2]\}. \tag{6}$$

The output of mixer 804B is provided to the low pass filter 806B. The low pass filter 806B blocks the high frequency term $\omega_1+\omega_2$ and passes the low frequency term $\Delta\omega=\omega_1-\omega_2$, producing signal:

$$\sigma_2(t)=\frac{1}{4}V_1 e^{-\alpha L}\sin(\Delta\omega t-\beta L+\theta_1-\theta_2) \tag{7}$$

Signals $\rho_2(t)$ and $\sigma_2(t)$ are digitized by the A/D converters 808A and 808B, and the digitized signals are provided to the processor 810 for further processing.

Having acquired WDP characterization data using signal propagating in one direction along the WDP 118 (e.g., uphole to downhole), characterization data is acquired using signal propagating in the opposite direction along the WDP 118 (e.g., downhole to uphole). Thus, consider FIG. 8B where repeater sub 132B is downhole from repeater sub 132A and the signals $\rho_2(t)$ and $\sigma_2(t)$ described above have been acquired by propagating signal from repeater sub 132A downhole to 132B. The oscillators 812 continue to operate at the same angular frequencies, $\omega_1$ and $\omega_2$ and with the same phases, $\theta_1$ and $\theta_2$. The repeater sub 132B generates the signal $V_2 \sin(\omega_2 t+\theta_2)$. The voltage $V_2$ can be either set to a specific value or measured in the repeater sub 132B, and the voltage value digitally transmitted to the repeater sub 132A. The upward propagating wave on the WDP transmission line at any location x and any time t is $V_2 e^{\alpha(x-L)} \sin(\omega_2 t+\beta(x-L)+\theta_2)$.

The signal received at the repeater sub 132A is $V_2 e^{-\alpha L} \sin(\omega_2 t-\beta L+\theta_2)$. The repeater sub 132A splits the received signal into two equal signals $$\frac{1}{2}V_2 e^{-\alpha L}\sin(\omega_2 t-\beta L+\theta_2)$$

and provides one of the two signals to each of the mixers 804A, 804B. The oscillator 812 of the sub 132B provides mixer 804A with a signal $V \sin(\omega_1 t+\theta_1)$, and provides mixer 804B with a signal $V \cos(\omega_1 t+\theta_1)$, where V=1 volt for simplicity. Mixer 804A mixes $$\frac{1}{2}V_2e^{-\alpha L}\sin(\omega_2 t-\beta L+\theta_2)$$

and V $\sin(\omega_1 t+\theta_1)$ producing:

$$\delta_1(t)=\frac{1}{2}V_2e^{-\alpha L}\sin(\omega_2 t-\beta L+\theta_2)\sin(\omega_1 t+\theta_1), \tag{8}$$

$$\delta_1(t)=\frac{1}{4}V_2e^{-\alpha L}\{\cos[(\omega_2-\omega_1)t-\beta L+\theta_2-\theta_1]-\cos[(\omega_1+\omega_2)t-\beta L+\theta_1+\theta_2]\}. \tag{9}$$

Mixer 804B mixes $$\frac{1}{2}V_2e^{-\alpha L}\sin(\omega_2 t-\beta L+\theta_2)\text{ and }V\cos(\omega_1 t+\theta_1)$$

producing:

$$\varepsilon_1(t)=\frac{1}{2}V_2e^{-\alpha L}\sin(\omega_2 t-\beta L+\theta_2)\sin(\omega_1 t+\theta_1), \tag{10}$$

$$\varepsilon_1(t)=\frac{1}{4}V_2e^{-\alpha L}\{\cos[(\omega_2-\omega_1)t-\beta L+\theta_2-\theta_1]-\cos[(\omega_1+\omega_2)t-\beta L+\theta_1+\theta_2]\}. \tag{11}$$

The outputs of the mixers 804A, 804B are provided to the low pass filters 806A, 806B. From the mixer output data, the low pass filters 806A, 806B respectively produce $$\delta_2(t)=\frac{1}{4}V_2e^{-\alpha L}\cos(\Delta\omega t-\beta L+\theta_2-\theta_1)\text{ and} \tag{12}$$

$$\varepsilon_2(t)=\frac{1}{4}V_2e^{-\alpha L}\sin(\Delta\omega t-\beta L+\theta_2-\theta_1). \tag{13}$$

Signals $\delta_2(t)$ and $\epsilon_2(t)$ are digitized by the A/D converters 808A and 808B, and the digitized signals are provided to the processor 810 for further processing.

The instantaneous values $\rho_2(t)$, $\sigma_2(t)$, $\delta_2(t)$ and $\epsilon_2(t)$ are integrated using integration circuitry ahead of the A/D converters 808A and 808B or by the processor 810 using a measurement time series. If a first repeater sub 132A is transmitting sinusoidal signal to a second repeater sub 132B during time $t\in[-T,0]$, and the second repeater sub 132B is transmitting sinusoidal signal to a first repeater sub 132A during time $t\in[0,T]$, then integration of each of $\rho_2(t)$, $\sigma_2(t)$, $\delta_2(t)$ and $\epsilon_2(t)$ produces:

$$\rho_3=\frac{1}{T}\int_{-T}^{0}\rho_2(t)dt, \tag{14}$$

$$\sigma_3=\frac{1}{T}\int_{-T}^{0}\sigma_2(t)dt, \tag{15}$$

$$\delta_3=\frac{1}{T}\int_{0}^{T}\delta_2(t)dt,\text{ and} \tag{16}$$

$$\varepsilon_3=\frac{1}{T}\int_{0}^{T}\varepsilon_2(t)dt. \tag{17}$$

Embodiments may let $\phi_1\equiv\theta_1-\theta_2-\beta L$, and set the variable of integration to $u\equiv\Delta\omega t+\phi_1$, resulting in:

$$\rho_3=\frac{1}{T}\int_{-T}^{0}dt\left\{\frac{1}{4}V_1e^{-\alpha L}\cos(\Delta\omega t+\phi_1)\right\}=\frac{V_1e^{-\alpha L}}{4\Delta\omega T}\int_{\phi_1-\Delta\omega T}^{\phi_1}du\{\cos u\} \tag{18}$$

$$\rho_3=\frac{V_1e^{-\alpha L}}{4\Delta\omega T}\{\sin\phi_1-\sin(\phi_1-\Delta\omega T)\}=\frac{V_1e^{-\alpha L}}{4\Delta\omega T}\{2\cos(\phi_1-\Delta\omega T/2)\sin(\Delta\omega T/2)\} \tag{19}$$

$$\rho_3=\frac{V_1e^{-\alpha L}}{4}\cos(\phi_1-\Delta\omega T/2)\left[\frac{\sin(\Delta\omega T/2)}{\Delta\omega T/2}\right] \tag{20}$$

$$\rho_3=\frac{V_1e^{-\alpha L}}{4}\cos(\theta_1-\theta_2-\beta L-\Delta\omega T/2)\left[\frac{\sin(\Delta\omega T/2)}{\Delta\omega T/2}\right]. \tag{21}$$

The ratio $$\frac{\sin(\Delta\omega T/2)}{\Delta\omega T/2}$$

remains close to unity for small values of $\Delta\omega T$. Since the two oscillators 812 are very close in frequency, $\Delta\omega T\ll 1$ can be achieved.

$\sigma_3$ is similarly integrated:

$$\sigma_3=\frac{1}{T}\int_{-T}^{0}dt\left\{\frac{1}{4}V_1e^{-\alpha L}\sin(\Delta\omega t+\phi_1)\right\}=\frac{V_1e^{-\alpha L}}{4\Delta\omega T}\int_{\phi_1-\Delta\omega T}^{\phi_1}du\{\sin u\} \tag{22}$$

$$\sigma_3=\frac{V_1e^{-\alpha L}}{4\Delta\omega T}\{\cos(\phi_1-\Delta\omega T)-\cos\phi_1\}=\frac{V_1e^{-\alpha L}}{4\Delta\omega T}\{2\sin(\phi_1-\Delta\omega T/2)\sin(\Delta\omega T/2)\} \tag{23}$$

$$\sigma_3=\frac{V_1e^{-\alpha L}}{4}\sin(\phi_1-\Delta\omega T/2)\left[\frac{\sin(\Delta\omega T/2)}{\Delta\omega T/2}\right] \tag{24}$$

$$\sigma_3=\frac{V_1e^{-\alpha L}}{4}\sin(\theta_1-\theta_2-\beta L-\Delta\omega T/2)\left[\frac{\sin(\Delta\omega T/2)}{\Delta\omega T/2}\right]. \tag{25}$$

For $\delta_2(t)$ and $\epsilon_2(t)$, embodiments may let $\phi_2\equiv\theta_1-\theta_2+\beta L$, and set the variable of integration to $u\equiv\Delta\omega t+\phi_2$, resulting in:

$$\delta_3=\frac{1}{T}\int_{0}^{T}dt\left\{\frac{1}{4}V_2e^{-\alpha L}\cos(\Delta\omega t+\phi_2)\right\}=\frac{V_2e^{-\alpha L}}{4\Delta\omega T}\int_{\phi_2}^{\phi_2+\Delta\omega T}du\{\cos u\} \tag{26}$$

$$\delta_3=\frac{V_2e^{-\alpha L}}{4}\cos(\phi_2+\Delta\omega T/2)\left[\frac{\sin(\Delta\omega T/2)}{\Delta\omega T/2}\right] \tag{27}$$

$$\delta_3=\frac{V_2e^{-\alpha L}}{4}\cos(\theta_1-\theta_2+\beta L+\Delta\omega T/2)\left[\frac{\sin(\Delta\omega T/2)}{\Delta\omega T/2}\right] \tag{28}$$

$$\varepsilon_3=\frac{1}{T}\int_{0}^{T}dt\left\{-\frac{1}{4}V_2e^{-\alpha L}\sin(\Delta\omega t+\phi_2)\right\}=\frac{V_2e^{-\alpha L}}{4\Delta\omega T}\int_{\phi_2}^{\phi_2+\Delta\omega T}du\{\sin u\} \tag{29}$$

$$\varepsilon_3=\frac{V_2e^{-\alpha L}}{4}\sin(\phi_2+\Delta\omega T/2)\left[\frac{\sin(\Delta\omega T/2)}{\Delta\omega T/2}\right] \tag{30}$$

$$\varepsilon_3=\frac{V_2e^{-\alpha L}}{4}\sin(\theta_1-\theta_2+\beta L+\Delta\omega T/2)\left[\frac{\sin(\Delta\omega T/2)}{\Delta\omega T/2}\right]. \tag{31}$$

Based on the foregoing, embodiments generate $\alpha(\omega)$ (i.e., the real part of $\gamma(\omega)$) by combining terms $\rho_3$ and $\sigma_3$.

$$\rho_3^2+\sigma_3^2=\frac{1}{16}V_1^2e^{-2\alpha L}\left[\frac{\sin(\Delta\omega T/2)}{\Delta\omega T/2}\right]^2,\text{ and therefore,} \tag{32}$$

$$\alpha(\omega)=-\frac{1}{2L}\ln\left\{16\frac{\rho_3^2+\sigma_3^2}{V_1^2}\right\}+\frac{1}{2L}\ln\left\{\frac{\sin(\Delta\omega T/2)}{\Delta\omega T/2}\right\}. \tag{33}$$

The logarithm involving $\Delta\omega T/2$ is very small for reasonable values of $\Delta\omega T$.

Similarly, embodiments may generate $\alpha$ by combining terms $\delta_3$ and $\epsilon_3$.

$$\alpha(\omega)=-\frac{1}{2L}\ln\left\{16\frac{\delta_3^2+\varepsilon_3^2}{V_2^2}\right\}+\frac{1}{2L}\ln\left\{\frac{\sin(\Delta\omega T/2)}{\Delta\omega T/2}\right\} \tag{34}$$

Both $\delta_3$ and $\epsilon_3$ include the term $\theta_1-\theta_2+\beta L\alpha\Delta\omega T/2$. Compared to $\rho_3$ and $\sigma_3$, the signs of $\beta L$ and $\Delta\omega T/2$ change with respect to the phase difference $(\theta_1-\theta_2)$. Accordingly, embodiments can eliminate the phase difference by combining expressions for the two directions of signal propagation. To determine the imaginary part $\beta(\omega)$ of the propagation constant $\gamma(\omega)$, embodiments form the ratios:

$$\frac{\sigma_3}{\rho_3}=\tan(\phi_1-\Delta\omega T/2)=\tan(\theta_1-\theta_2-\beta L-\Delta\omega T/2),\text{ and} \tag{35}$$

$$\frac{\varepsilon_3}{\delta_3}=\tan(\phi_2-\Delta\omega T/2)=\tan(\theta_1-\theta_2+\beta L+\Delta\omega T/2). \tag{36}$$

From the ratios, embodiments compute $$\theta_1-\theta_2-\beta L-\Delta\omega T/2=\tan^{-1}\left(\frac{\sigma_3}{\rho_3}\right)\text{ and} \tag{37}$$

$$\theta_1-\theta_2+\beta L+\Delta\omega T/2=\tan^{-1}\left(\frac{\varepsilon_3}{\delta_3}\right). \tag{38}$$

Subtracting the two equations, embodiments compute:

$$\beta(\omega)=\frac{1}{2L}\left\{\tan^{-1}\left(\frac{\varepsilon_3}{\delta_3}\right)-\tan^{-1}\left(\frac{\sigma_3}{\rho_3}\right)\right\}-\frac{\Delta\omega T}{2L}. \tag{39A}$$

Figure 9:
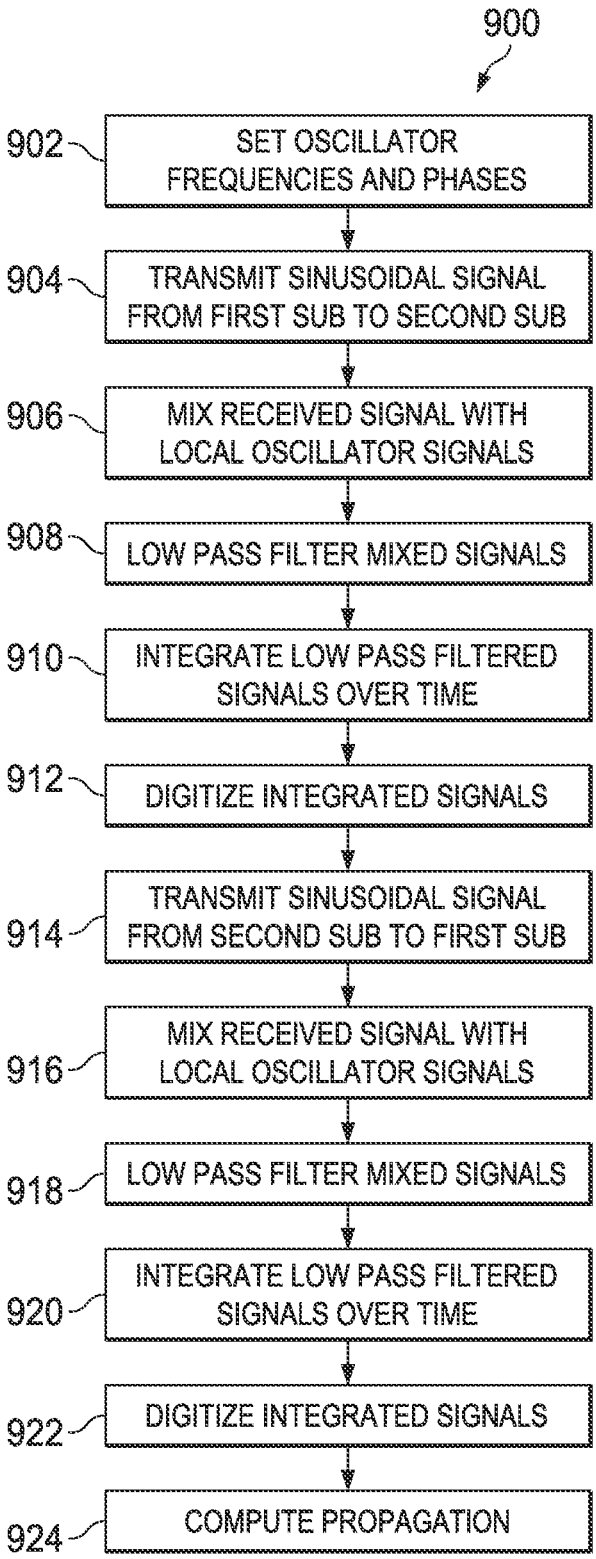
FIG. 9 shows a flow diagram for a method for determining the propagation constant for wired drill pipe in accordance with various embodiments.

FIG. 9 shows a flow diagram for a method 900 for determining the propagation constant for WDP 118 in accordance with various embodiments. Though depicted sequentially as a matter of convenience, at least some of the actions shown can be performed in a different order and/or performed in parallel. Additionally, some embodiments may perform only some of the actions shown. The operations of the method 900 can be performed by the drilling system 100. In some embodiments, at least some of the operations of the method 900, as well as other operations described herein, can be performed by a processor executing instructions stored in a computer readable medium.

In the method 900, the drill string 108, comprising WDPs 118, is disposed in the borehole 116. Two or more calibration subs 802 are coupled to the drill string 108. The calibration subs 802 cooperatively characterize the WDPs 118 to determine the propagation constant $\gamma(\omega)$. In some embodiments, the calibration subs 802 are included in the WDP repeater subs 132. Other embodiments position the calibration subs 802 at various locations in the drill string 118. The method 900 is described with reference to an embodiment of the WDP repeater sub 132 that includes the calibration sub 802.

In block 902, two repeater subs 132A and 132B are configured to exchange sinusoidal signal transmissions via the WDP 118. The frequencies and phases of the signals to be exchanged are set. Signal frequency and phase may, for example, be set via command from the surface or preprogrammed into the repeater subs 132. The oscillators 812 of the repeater subs 132, which generate the set frequencies, may not generate precisely the same frequencies.

In block 904, a first of two repeater subs 132A transmits sinusoidal signal to the second of the repeater subs 132B via the WDP 118. The first of the repeater subs 132A may be, for example, uphole from the second repeater sub 132B.

In block 906, the second repeater sub 132B receives the sinusoidal signal transmitted by the first repeater sub 132A and splits the received signal into two identical copies. One of the copies is provided to each of two mixers 804 of the second repeater sub 132B. Each mixer 804 mixes the received sinusoidal signal with one of two sinusoidal signals generated by the oscillator 812 of the second repeater sub 132B. The two sinusoidal signals provided by the oscillator 812 of the second repeater sub 132B (one to each mixer 804) are offset in phase by 90°. The mixers 804 produce output signals in accordance with equations (10) and (13).

In block 908, the signals generated by the mixers 804 are filtered by the low pass filters 806. The low pass filters 806 eliminate or reduce high frequency components of the mixer output signals to produce signal outputs in accordance with equations (11) and (14).

In block 910, the low pass filtered signals are integrated over time. Embodiments may perform the integration before or after the filtered signals are digitized by the A/D converters 808 in block 912. Embodiments integrate the filtered signals in accordance with equations (21)-(24), (28), (32), (35), and (38). The second repeater sub 132B may transmit the digitized integrated signal to the first repeater 132A or to a processor 810 disposed at the surface or in the drill string 108.

In block 914, the two repeater subs 132 are reconfigured such that the second repeater sub 132B transmits sinusoidal signal to the first repeater sub 132A via the WDP 118. The frequency and phase of the sinusoidal signal transmitted remains unchanged from the setting applied in block 902.

In block 916, the first repeater sub 132A receives the sinusoidal signal transmitted by the second repeater sub 132B and splits the received signal into two identical copies. One of the copies is provided to each of two mixers 804 of the first repeater sub 132A. Each mixer 804 mixes the received sinusoidal signal with a signal generated by the oscillator 812 of the first repeater sub 132A. The two sinusoidal signals provided by the oscillator 812 of the first repeater sub 132A (one to each mixer 804) are offset in phase by 90°. The mixers 804 produce output signals in accordance with equations (16) and (18).

In block 918, the signals generated by the mixers 804 are filtered by the low pass filters 806 of the first repeater sub 132A. The low pass filters 806 of the first repeater sub 132A eliminate or reduce high frequency components of the mixer output signals to produce signal outputs in accordance with equations (19) and (20).

In block 920, the low pass filtered signals are integrated over time. Embodiments may perform the integration before or after the filtered signals are digitized by the A/D converters 808 of the first repeater sub 132A in block 922. Embodiments integrate the filtered signals in accordance with equations (23), (24), (35), and (38). The first repeater sub 132A may transmit the digitized integrated signal to the second repeater 132B or to a processor 810 disposed at the surface or in the drill string 108.

In block 922, the low pass filtered signals are digitized. Embodiments may perform the integration before or after the filtered signals are digitized by the A/D converters 808 in block 922.

In block 924 the processor 810 computes the propagation constant of the WDP 118 based on the information provided by the first and second repeater subs 132. The processor 810 computes the propagation constant in accordance with equations (40), (41), and (46A).

The phase difference between the two oscillators 612 may be determined by adding equations (44) and (45):

$$\theta_1 - \theta_2 = \frac{1}{2}\tan^{-1}\left(\frac{\sigma_3}{\rho_3}\right) + \frac{1}{2}\tan^{-1}\left(\frac{\varepsilon_3}{\delta_3}\right). \tag{46B}$$

Once the phase difference between the two oscillators 812 has been determined from equation (46B), the phase difference can be set to 0 degrees by adjusting the phase of one or the other oscillator 812. As is well known, synchronizing the phases of two oscillators can be used to synchronize the frequencies of the two oscillators. Two synchronized oscillators can then be used as clocks for measurements requiring accurate timing. An example of a measurement requiring synchronized oscillators is measuring the arrival times of seismic signals at two physically separated locations.

Returning now to WDP fault detection, unlike broad band WDP systems that employ conductive contacts, with the inductively coupled WDPs 118, open circuits cannot be distinguished from short circuits by measuring the impedance at low frequencies. Because the lowest frequency useful with the inductively coupled WDPs 118 may be relatively high (e.g., 4 MHz), there can be many wavelengths between the impedance measurement system 404 and the fault. Consequently, the fault monitor 400 applies different techniques to locate a fault in WDPs 118 than would be applied to conductively coupled WDPs.

Figure 10:
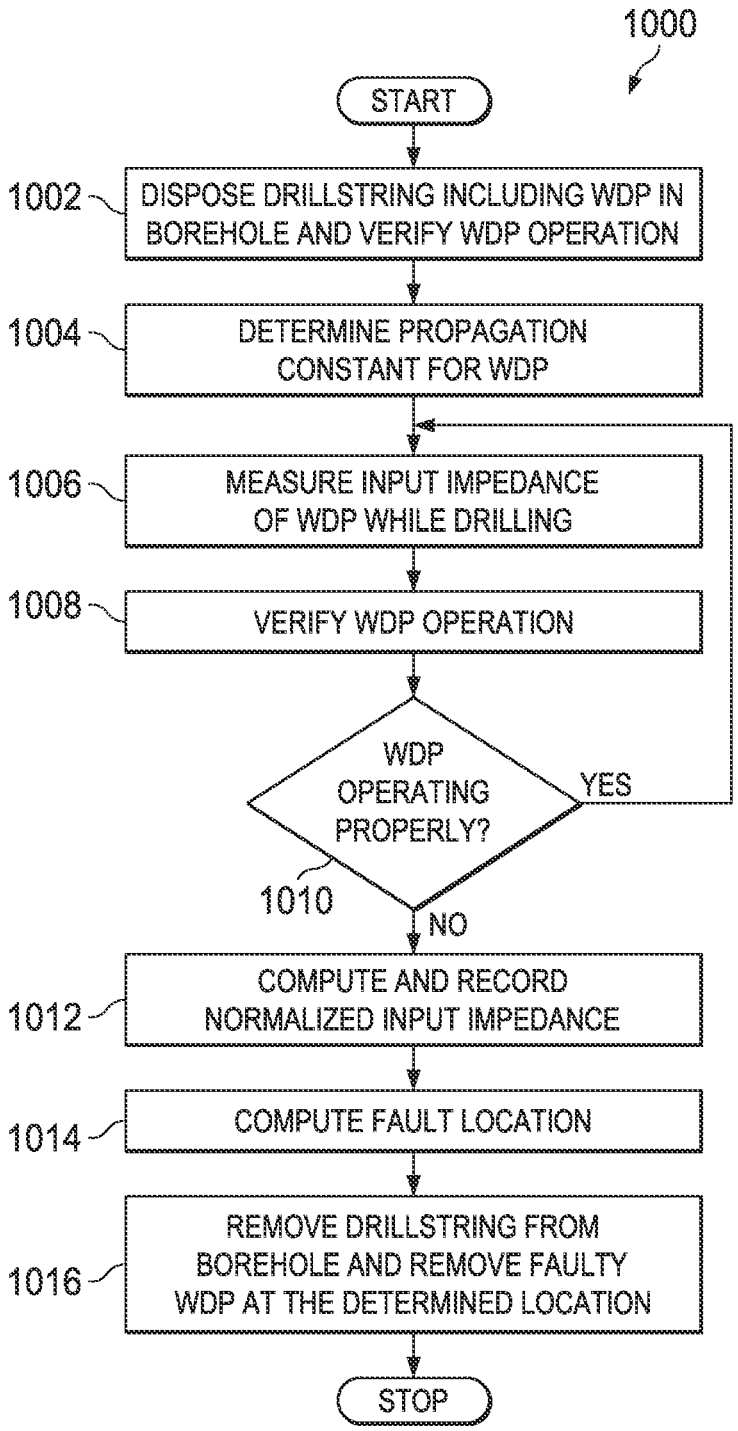
FIG. 10 shows a flow diagram for a method for determining the location of a fault in wired drill pipe in accordance with principles disclosed herein.

FIG. 10 shows a flow diagram for a method 1000 for determining the location of a fault in wired drill pipes 118 in accordance with principles disclosed herein. Though depicted sequentially as a matter of convenience, at least some of the actions shown can be performed in a different order and/or performed in parallel. Additionally, some embodiments may perform only some of the actions shown. The operations of the method 1000 may be performed by the fault monitor 400. At least some of the operations of the method 1000 can be performed by the processor 408 executing instructions read from a computer-readable medium (e.g., storage 410).

In block 1002, the drill string 108 is disposed in the borehole 116. The drill string 108 includes a downhole communication network comprising WDPs 118 and one or more WDP fault monitors 400. Proper operation of the WDPs 118 is verified, for example, by validation of information packets transferred through the WDPs 118 and/or validation of an expected WDP input impedance.

Figure 11A:
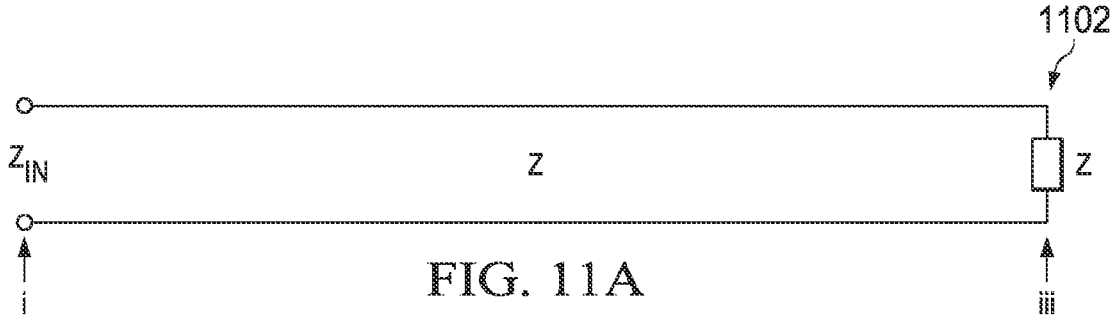
FIGS. 11A-11F show schematic diagrams of wired drill pipe cable and inductive couplers for determining attenuation and phase velocity in accordance with principles disclosed herein.
Figure 11B:
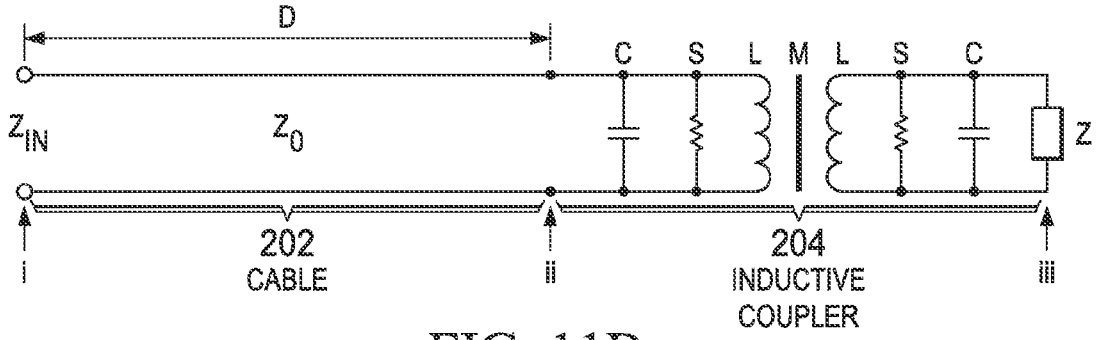
Figure 11C:
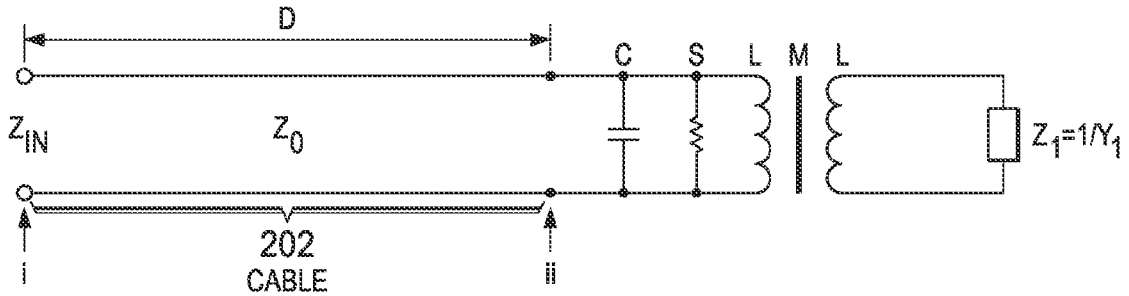
Figure 11D:
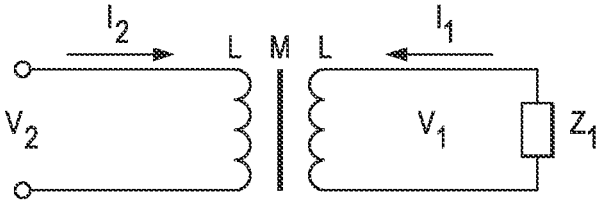
Figure 11E:
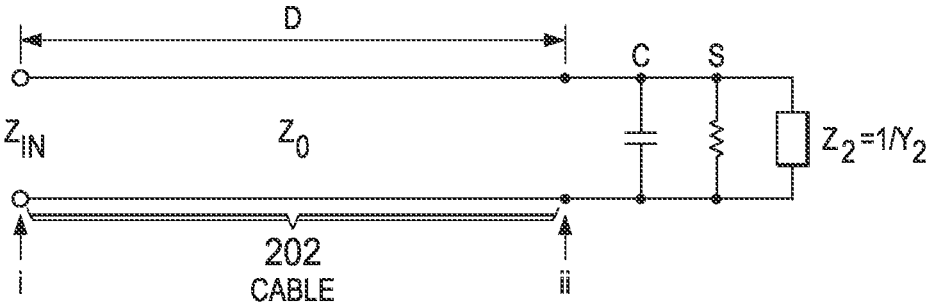
Figure 11F:
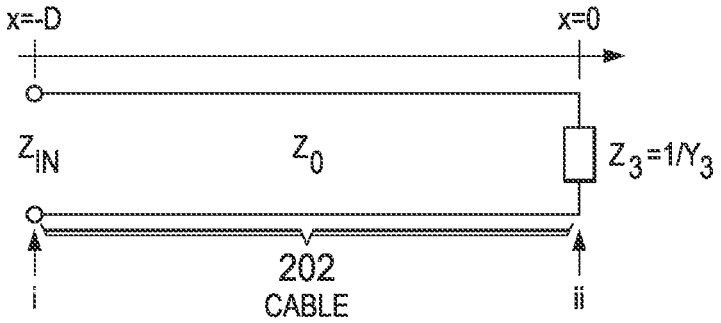

In block 1004, the fault monitor 400 determines a propagation constant for the WDPs 118. The WDPs 118 have a propagation constant $\gamma(\omega)=\alpha(\omega)+j\beta(\omega)$ that is different from the propagation constant $\gamma_0=\alpha_0+j\beta_0$ for the cable 202. Referring to FIG. 11A, the load impedance at location 1102 is Z; hence the reflection coefficient is zero, $\Gamma=0$. The propagation constant for the WDPs 118 is:

$$\gamma = \frac{1}{D}\ln\left\{\left(\frac{Z_1Z_3}{ZZ_2}\right)\left(\frac{j\omega M}{Z_1 + j\omega L}\right)\left(\frac{Z_0}{Z_0\cosh(\gamma_0 D) + Z_3\sinh(\gamma_0 D)}\right)\right\}, \tag{47}$$

and $$\alpha = \frac{1}{D}\mathrm{Real}\left[\ln\left\{\left(\frac{Z_1Z_3}{ZZ_2}\right)\left(\frac{j\omega M}{Z_1 + j\omega L}\right)\left(\frac{Z_0}{Z_0\cosh(\gamma_0 D) + Z_3\sinh(\gamma_0 D)}\right)\right\}\right], \tag{48}$$

$$\beta = \frac{1}{D}\mathrm{Imag}\left[\ln\left\{\left(\frac{Z_1Z_3}{ZZ_2}\right)\left(\frac{j\omega M}{Z_1 + j\omega L}\right)\left(\frac{Z_0}{Z_0\cosh(\gamma_0 D) + Z_3\sinh(\gamma_0 D)}\right)\right\}\right], \tag{49}$$

where:

$\gamma_0$ is the known propagation constant of the cable 202;

D is the length of the WDPs 118 (e.g., approximated as length of cable 202);

L is series inductance;

S is shunt resistance;

C is shunt capacitance;

M is mutual inductance between two inductive couplers; and $Z_0$–$Z_3$ are impedances as indicated in FIGS. 11A-11F.

In block 1006, while drilling, the impedance measurement system 404 measures the input impedance of the wired drill pipes 118 coupled to the fault monitor 400. The impedance measurement system 404 measures the input impedance of the WDPs 118 for a plurality of angular frequencies ω spanning the bandwidth of the WDPs 118 (e.g., 4 MHz-8 MHz). The impedance measurement may be performed at least once when a new joint of WDP 118 is added to the drill string 108. The input impedance may be measured for each section of WDPs 118 that is separated by fault monitors 400 (e.g., repeater subs 132 that include a fault monitor 400) so that all sections of WDPs 118 are characterized.

In block 1008, proper operation of the WDPs 118 is verified. The verification may include validating continued telemetry function (e.g., transmitting an information packet through the WDPs 118 and validating that the packet is received without error), and/or that the measured input impedance is within predetermined limits (e.g., limits based on the resolution or random noise of the WDP telemetry system). If the WDPs 118 are operating properly in block 1010, then the impedance measurement is periodically repeated in block 1006.

If the WDPs 118 are not operating properly in block 1010, then fault distance evaluation logic 416 is applied to compute, as shown in equation (7), and record the normalized input impedance in block 1012. The measured impedance values may be stored in the sub (e.g., sub 132, 134) for retrieval when the drill string is extracted from the borehole 116.

In block 1014, the fault monitor 400 computes the location of the fault. The fault monitor 400 may apply one or a combination of techniques disclosed herein to compute the distance to the fault, where the distance from the fault monitor 400 to the fault identifies the location of the fault. The location determination may be performed at the surface using impedance measurements stored in the sub (e.g., sub 132, 134), or retrieved from the sub that performed the location determination for WDPs 118 uphole of the sub, where the fault prevents transmission of information from the sub. For a fault located downhole of the fault monitor 400, the fault monitor may transmit impedance measurements, and/or location determinations to the surface. Thus, embodiments may employ fault location determinations from both uphole and downhole of the fault to improve location accuracy.

In block 1016, the fault monitor 400 has determined the location of the fault to within a few joints of WDP 118. The drill string 108 is extracted from the borehole 116, and the WDP(s) 118 at the determined fault location is removed from the drill string 116 and replaced.

Figure 12:
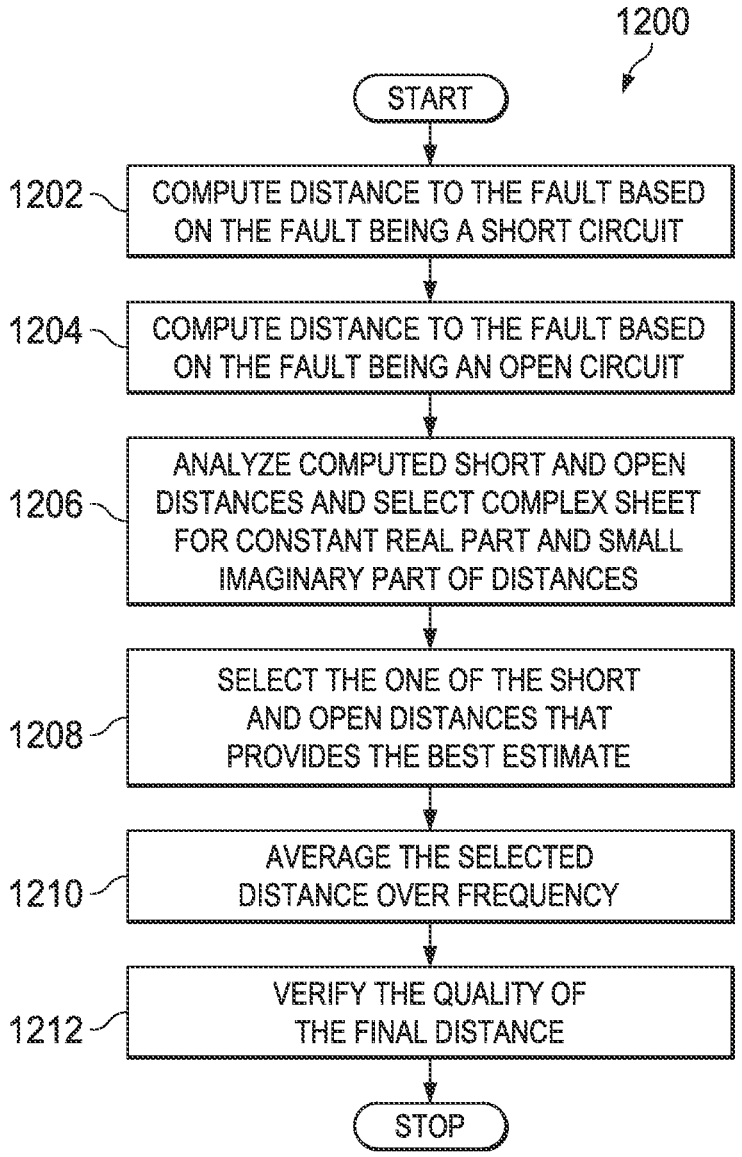
FIG. 12 shows a flow diagram for a method for determining the distance to a fault in wired drill pipe in accordance with principles disclosed herein

FIG. 12 shows a flow diagram for a method 1200 for determining the distance to a fault in wired drill pipes 118 in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 1200 can be performed by the processor 408 executing instructions read from a computer-readable medium (e.g., storage 410). The method 1200 may be applied alone or in combination with other fault distance determination methods disclosed herein to compute the location of a fault in block 1014 of the method 1000.

In block 1202, the fault monitor 400 has determined that a fault is present in the wired drill pipes 118. The fault monitor 400 computes an apparent distance to the fault based on the assumption that the fault is a short circuit. The short-based distance is computed as:

$$L'(\omega) = \frac{1}{2\gamma(\omega)}\ln\left\{\frac{1+\zeta(\omega)}{1-\zeta(\omega)}\right\}, \tag{50}$$

where:

$\zeta(\omega)$ is the normalized WDP input impedance from equation (7); and $\gamma(\omega)$ is the propagation constant for the WDP.

In block 1204, the fault monitor 400 computes an apparent distance to the fault based on the assumption that the fault is an open circuit. The open-based distance is computed as:

$$L'(\omega) = \frac{1}{2\gamma(\omega)}\ln\left\{\frac{\zeta(\omega)+1}{\zeta(\omega)-1}\right\}. \tag{51}$$

Frequency dependence is shown in equations (50)-(51) as a reminder that the apparent distance to the fault $L'(\omega)$ may be a function of frequency when measurement errors or inversion errors are present. However, a robust distance solution should exhibit minimal frequency dependence and be a real number.

The natural logarithm of a complex number is multi-valued and has a branch cut along the negative real-axis in the complex plane. In general, the natural logarithm of a complex number returns an imaginary part modulo $2\pi$: i.e. $\ln(re^{j\theta})=\ln(r)+j(\theta+n2\pi)$, where n is an integer. Therefore, the fault monitor 400 must choose the correct complex sheet (i.e. the correct value for n) when applying equations (50)-(51). Otherwise, an incorrect value for $L'(\omega)$ may be obtained. The value of n may change over the measurement bandwidth. Incorrect choices for n may be indicated by abrupt changes in the apparent distance $L'(\omega)$ versus frequency. Also, incorrect choices for n may be indicated by $L'(\omega)$ having large, non-zero imaginary values. Hence, the fault monitor 400 can use the variation of $L'(\omega)$ with angular frequency w and the imaginary part of $L'(\omega)$ as quality control indicators.

Figure 13A:
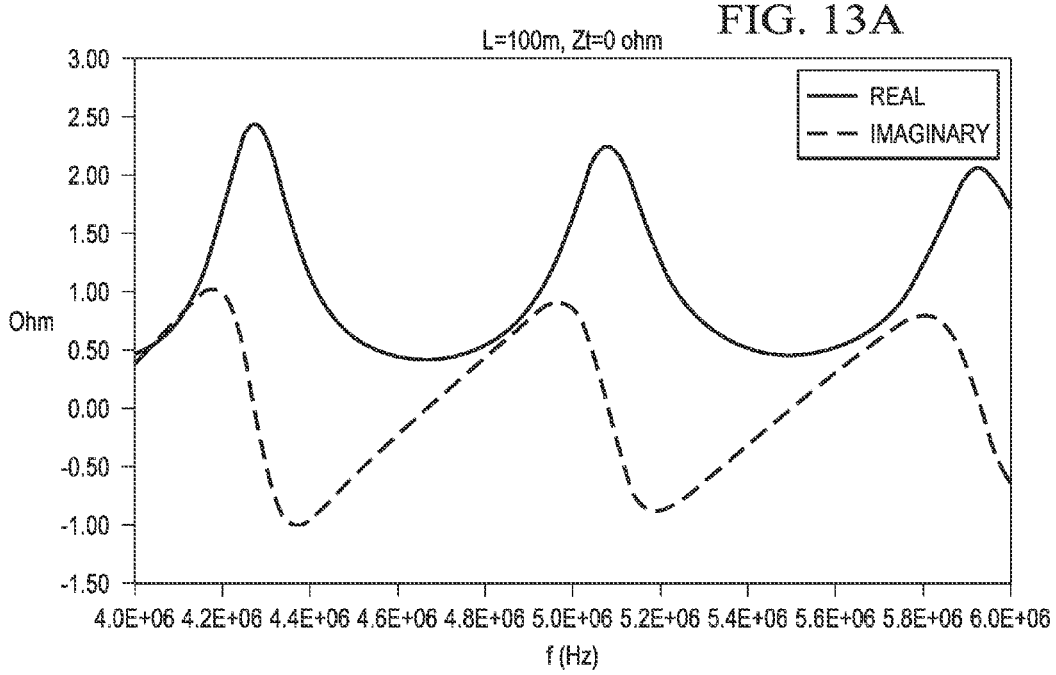
FIG. 13A shows a plot of normalized input impedance for a short circuit in the wired drill pipe located 100 meters from a fault monitor computed in accordance with principles disclosed herein.
Figure 13B:
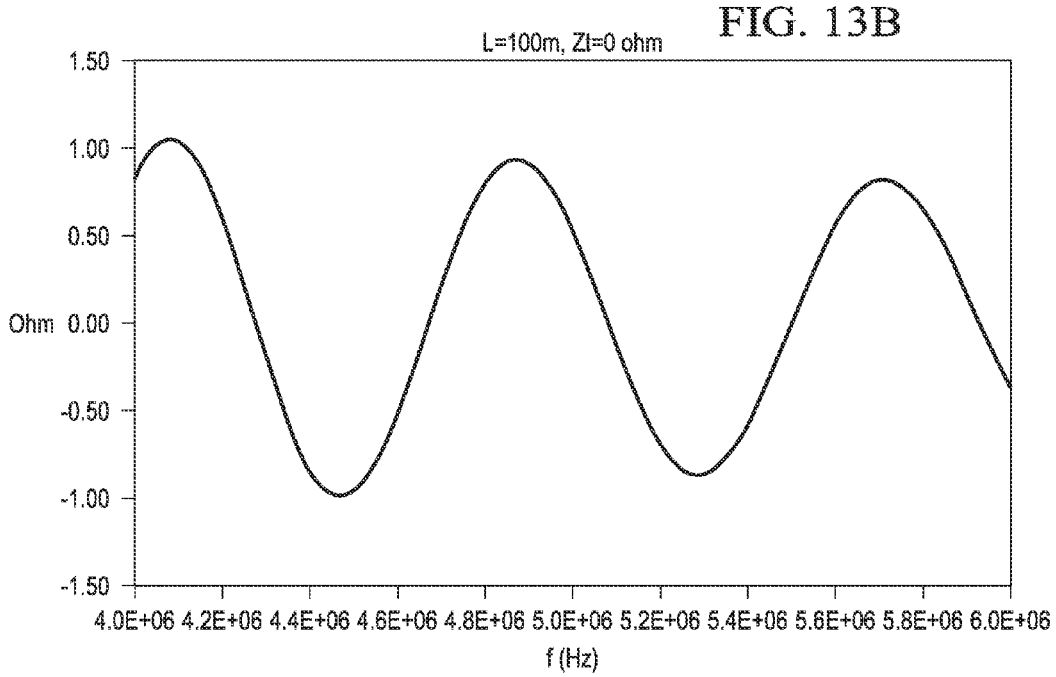
FIG. 13B shows a plot of the ratio of imaginary part to real part of the normalized input impedance.
Figure 13C:
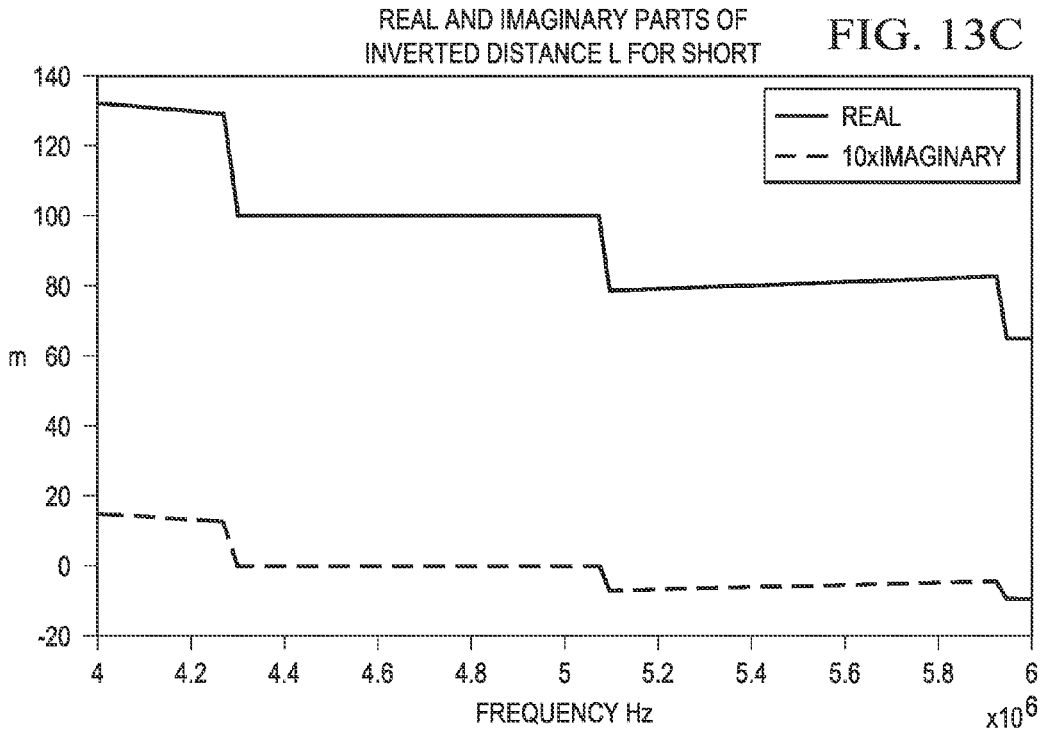
FIG. 13C shows a plot of distance to the short computed in accordance with principles disclosed herein.
Figure 13D:
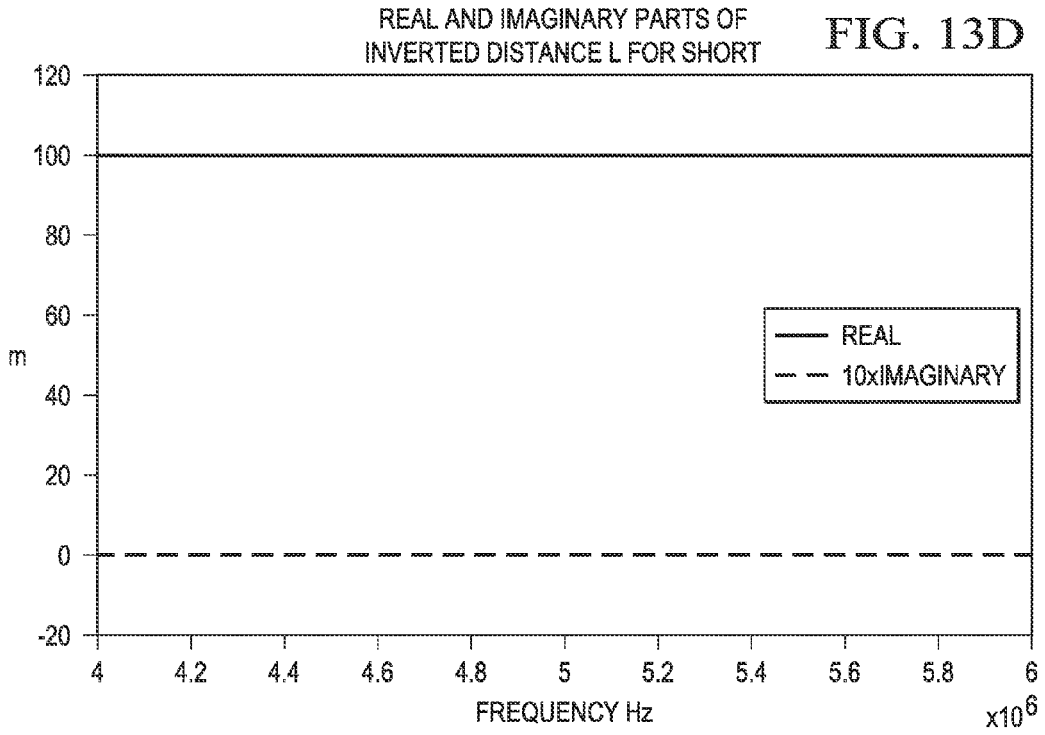
FIG. 13D shows a plot of distance to the short accounting for branch cuts in accordance with principles disclosed herein.

FIG. 13A is an example where the normalized input impedance $\zeta=\zeta'+j\zeta''$ is plotted for a short ($Z_t=0$) located 100 m from the fault monitor 400. FIG. 13B is a plot of the ratio of the imaginary part to the real part, $\zeta''(\omega)/\zeta'(\omega)$, for the data plotted in FIG. 13A. Using equation (50) for a short, and inverting for $L'(\omega)$ with n=4 for frequencies between 4 and 6 MHz produces the results shown in FIG. 13C. Between 4.3 MHz and 5.1 MHz, $\mathrm{Imag}\{L'(\omega)\}=0$ and $\mathrm{Real}\{L'(\omega)\}=100$ m indicating a good fit to the data. Note that $\mathrm{Imag}\{L'(\omega)\}$ is multiplied by 10 in FIG. 13C. For other frequencies, $\mathrm{Imag}\{L'(\omega)\}\neq 0$ and $\mathrm{Real}\{L'(\omega)\}$ changes with frequency, with abrupt jumps in value at 4.3 MHz, 5.1 MHz, and 5.9 MHz. The abrupt jumps in $L'(\omega)$ are due to crossing branch cuts in the log function. Physically, this corresponds to additional wavelengths appearing between the fault and the measurement point. In FIG. 13D, the branch cuts are taken into account with n=3, 4, 5, 6 for the corresponding frequency ranges [4.0-4.3], [4.3-5.1], [5.1-5.9], and [5.9-6.0] MHz. The inverted distance is correctly determined to be $\mathrm{Real}\{L'(\omega)\}=100$ m, with $\mathrm{Imag}\{L'(\omega)\}=0$ across the frequency band.

If the short corresponding to FIGS. 13A and 13B is incorrectly assumed to be an open circuit and equation (51) is used rather than equation (50), the results shown in FIG. A13E are obtained. The imaginary part of $L'(\omega)$ is non-zero, and the real part of $L'(\omega)$ varies with frequency across the band, indicating an incorrect interpretation. Even so, the solution for the fault is still only in error by 2 drill pipe lengths (20 m) of the actual position. Hence the result is still useful since only one triple of drill pipe needs to be replaced.

In block 1206, the fault monitor 400 analyzes the distances computed for short and open circuits and selects a complex sheet for use with equations (50)-(51) that produces a relatively constant real part of the distance and/or a small imaginary part of the distance over the frequency range used to compute the distance. Multiple values of n may be applied over a given frequency range to reduce the length measurement frequency dependence. For example, a first value of n may be applied over a first frequency range to minimize distance error within the first range, and a second value of n may be applied to a second frequency range (non-overlapping with the first frequency range) to minimize distance computation error with the second range.

In block 1208, the fault monitor 400 selects one of the short circuit and open circuit distances to the best estimate of the actual distance to the fault. The selection may be based on which of the distances is most frequency independent in the real part of the distance and/or which of the distances has the smallest values for the imaginary part of the distance.

If the fault is distant from the fault monitor 400, and if there is noise present in the impedance measurement, then the location of the fault may be estimated by averaging the inverted distances $L'(\omega)$. In block 1210, the fault monitor 400 averages distance computed at each of a plurality of different frequencies. For example, distance may be averaged for each frequency over a selected range of angular frequencies $\{\omega_1, \omega_2, \omega_3, \ldots \omega_N\}$ as:

$$\langle L'\rangle = \frac{1}{N}\sum_{i=1}^{N} L'(\omega_i) \tag{52}$$

In block 1212, the fault monitor 400 verifies the quality of the final distance value. Some embodiments of the fault monitor 400 compute a standard deviation value for each of the imaginary part and the real part of the final distance value, where the final distance value should be within a predetermined range of the standard deviation. For example, a desired final distance value may be required to have an imaginary part that is approximately zero within two standard deviations. The standard deviations may be computed as:

$$\sigma_{Real} = \sqrt{\frac{1}{N}\sum_{i=1}^{N}([\mathrm{Real}\{\langle L'\rangle\}]^2 - [\mathrm{Real}\{L'(\omega_i)\}]^2)} \tag{53}$$

$$\sigma_{Imag} = \sqrt{\frac{1}{N}\sum_{i=1}^{N}([\mathrm{Imag}\{\langle L'\rangle\}]^2 - [\mathrm{Imag}\{L'(\omega_i)\}]^2)} \tag{54}$$

FIG. 14 shows a flow diagram for a method 1400 for determining the distance to a fault in wired drill pipes 118 in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 1400 can be performed by the processor 408 executing instructions read from a computer-readable medium (e.g., storage 410). The method 1400 may be applied alone or in combination with other fault distance determination methods disclosed herein to compute the location of a fault in block 1014 of the method 1000.

This method for locating the distance to the fault uses the zero crossings of $\zeta''(\omega)$, or of the ratio, $\zeta''(\omega)/\zeta'(\omega)$. Referring to FIGS. 13A and 13B, it can be seen that $\zeta'(\omega)$, $\zeta''(\omega)$, and $\zeta''(\omega)/\zeta'(\omega)$ have periodic frequency dependences. Let $\Gamma=\Gamma'+j\Gamma''=|\Gamma|e^{j\Phi}$ and substitute this into equation (7) along with $\gamma(\omega)=\alpha(\omega)+j\beta(\omega)$:

$$\zeta'(\omega) = \frac{1-|\Gamma|^2 e^{-4\alpha L_f}}{1+|\Gamma|^2 e^{-4\alpha L_f} - 2\Gamma' e^{-2\alpha L_f}\cos(2\beta L_f) - 2\Gamma'' e^{-2\alpha L_f}\sin(2\beta L_f)} \tag{55}$$

$$\zeta''(\omega) = -\frac{2e^{-2\alpha L_f}(\Gamma'\sin(2\beta L_f) - \Gamma''\cos(2\beta L_f))}{1+|\Gamma|^2 e^{-4\alpha L_f} - 2\Gamma' e^{-2\alpha L_f}\cos(2\beta L_f) - 2\Gamma'' e^{-2\alpha L_f}\sin(2\beta L_f)} \tag{56A}$$

$$\zeta''(\omega) = -\frac{2e^{-2\alpha L_f}|\Gamma|\sin(2\beta L_f - \phi)}{1+|\Gamma|^2 e^{-4\alpha L_f} - 2\Gamma' e^{-2\alpha L_f}\cos(2\beta L_f) - 2\Gamma'' e^{-2\alpha L_f}\sin(2\beta L_f)} \tag{56B}$$

$$\frac{\zeta''(\omega)}{\zeta'(\omega)} = \frac{2e^{-2\alpha L_f}|\Gamma|\sin(2\beta L_f - \phi)}{1-|\Gamma|^2 e^{-4\alpha L_f}} \tag{57}$$

The ratio $\zeta''(\omega)/\zeta'(\omega)$ has the form of an exponentially damped sinusoidal function in $L_f$, which is apparent in FIG. 13B. Equations (56) and (57) have zeros at $\tan(2\beta L_f)=\Gamma''/\Gamma'$ or when $2\beta L_f-\phi=n\pi$, where n is an integer. For a open circuit or a short circuit, the reflection coefficient $\Gamma$ will have a very small imaginary part, i.e. $|\Gamma'|>>|\Gamma''|$ or when $\phi\approx 0$ or $\phi\approx\pi$. Hence.

$$\tan(2\beta L_f) = \frac{\Gamma''}{\Gamma'} \Rightarrow 2\beta L_f = n\cdot\pi + \frac{\Gamma''}{\Gamma'}. \tag{58}$$

The solutions to equation (58) can be used to estimate the distance to the fault. Consider two sequential zero crossings at $\beta_1$ and $\beta_2$ such that $2\beta_1 L'=n\cdot\pi+\Gamma''/\Gamma'$ and $2\beta_2 L'=(n+1)\cdot\pi+\Gamma''/\Gamma'$. The correct value for n may not be known, but the apparent distance L' can be obtained from $$L' = \frac{\pi}{2(\beta_2-\beta_1)} = \frac{\pi/2}{\frac{\omega_2}{V_P(\omega_2)} - \frac{\omega_1}{V_P(\omega_1)}}, \tag{59}$$

where $V_P(\omega_n)$ is the phase velocity at the zero crossing $\omega_n$. While the zero crossings are measured frequencies, the phase velocity $V_P(\omega_n)$ must be known. If desired, several estimates of L' can be obtained from different pairs of zero crossings. These results can then be averaged to improve the quality of the estimated distance to the fault. This method also has the advantage of requiring data only a few discrete data points at frequencies surrounding the zero crossing. One strategy is taking a quick frequency scan to identify the approximate locations of the zero crossings, then to take additional data points near the zero crossings to improve the accuracy.

In block 1402, the fault monitor 400 has determined that a fault is present in the wired drill pipes 118. The fault monitor 400 analyzes WDP impedance data and identifies zero crossings therein. The WDP impedance data analyzed to identify zero crossings may be the imaginary part $\zeta''(\omega)$ of the measured impedance of the WDPs 118, or may be the ratio $\zeta''(\omega)/\zeta'(\omega)$ of the imaginary part to the real part of the measured impedance of the WDPs 118. To identify the zero crossings some embodiments may identify the approximate location of a zero crossing, then take additional data points near the zero crossings, and interpolate to find the zero crossing.

In block 1404, the fault monitor 400 selects one or more pairs of adjacent zero crossing $\{\omega_1, \omega_2, \omega_3, \ldots \omega_p\}$ from those identified. The selected pairs of zero crossings are processed, in block 1406, to determine distance to the fault. The fault monitor 400 may compute the distance L' to the fault according to equation (59).

In block 1408, the fault monitor 400 averages the distance values computed from different pairs of adjacent zero crossings as shown in equation (52) to improve the quality of the distance estimate.

Yet another method for locating a fault involves measuring the input impedance over a wide range of frequencies and then least squares fitting the measured data to equations for the input impedance. Since the reflection coefficient $\Gamma$ is essentially a real number, i.e. $|\Gamma'|>>|\Gamma''|$, equations (55), (56B), and (57) can be rewritten as $$h'(\omega) = \frac{1-(\Gamma')^2 e^{-4\alpha L'}}{1+(\Gamma')^2 e^{-4\alpha L'} - 2\Gamma' e^{-2\alpha L'}\cos(2\beta L')} \tag{60}$$

$$h''(\omega) = -\frac{e^{-2\alpha L'}2\Gamma'\sin(2\beta L')}{1+(\Gamma')^2 e^{-4\alpha L'} - 2\Gamma' e^{-2\alpha L'}\cos(2\beta L')} \tag{61}$$

$$g(\omega) = -\frac{e^{-2\alpha L'}2\Gamma'\sin(2\beta L')}{1-(\Gamma')^2 e^{-4\alpha L'}} \tag{62}$$

Since $\alpha(\omega)$ is a slowly varying function of frequency, and since $\Gamma'$ should be a constant, the frequency dependence occurs primarily in the terms $\sin(2\beta L')$ and $\cos(2\beta L')$. Equations (60) and (61) can be fit to measurements of $\zeta'(\omega)$ and $\zeta''(\omega)$, or equation (59) can be fit to the measured ratio $\zeta''(\omega)/\zeta'(\omega)$, to obtain $\Gamma'$ and L' with the knowledge of $\alpha(\omega)$ and $\beta(\omega)$. Simultaneously fitting the measured data to equations (60) and (61) is a robust procedure which requires a knowledge of $Z(\omega)$, the characteristic impedance. In practice, $Z(\omega)$ can be periodically measured while drilling before a fault occurs. Equation (61) does not require a knowledge of $Z(\omega)$, only the measurement of $Z_{IN}(\omega)$ since $\zeta''(\omega)/\zeta'(\omega)=\text{Imag}\{Z_{IN}(\omega)\}/\text{Real}\{Z_{IN}(\omega)\}$.

FIG. 15 shows a flow diagram for a method 1500 for determining the distance to a fault in wired drill pipes 118 in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 1500 can be performed by the processor 408 executing instructions read from a computer-readable medium (e.g., storage 410). The method 1500 may be applied alone or in combination with other fault distance determination techniques disclosed herein to compute the location of a fault in block 1014 of the method 1000.

In block 1502, the fault monitor 400 has determined that a fault is present in the wired drill pipes 118. The fault monitor 400 fits WDP impedance data to functions for the input impedance. The WDP impedance data fit to a function may be the real part $\zeta'(\omega)$ and imaginary part $\zeta''(\omega)$ of the measured impedance of the WDPs 118, or may be the ratio $\zeta''(\omega)/\zeta'(\omega)$ of the imaginary part to the real part of the measured impedance of the WDPs 118. The real part $\zeta'(\omega)$ and imaginary part $\zeta''(\omega)$ of the measured impedance of the WDPs 118 may be respectively fit to equations (60) and (61). The ratio $\zeta''(\omega)/\zeta'(\omega)$ of the imaginary part to the real part of the measured impedance of the WDPs 118 may be fit to the equation (62). $\Gamma'$ and $L'$ can be obtained from the fit functions based on $\alpha(\omega)$ and $\beta(\omega)$ being known.

Equations (60) and (61) can be simultaneously fit to the measured impedance using the least squares method. With N measurements of the complex input impedance at equally spaced angular frequencies $\{\omega_1, \omega_2, \omega_3, \ldots \omega_N\}$, there are 2N impedance data points $\{\zeta'(\omega_1), \zeta'(\omega_2), \zeta'(\omega_3), \ldots \zeta'(\omega_N), \zeta''(\omega_1), \zeta''(\omega_2), \zeta''(\omega_3), \ldots \zeta''(\omega_N)\}$. The variance between the impedance data and the two functions (equations (60) and (61)) is given by $$\chi^2 = \frac{1}{\sigma^2}\sum_{i=1}^{N}(h'(\omega_i)-\zeta'(\omega_i))^2 + \frac{1}{\sigma^2}\sum_{i=1}^{N}(h''(\omega_i)-\zeta''(\omega_i))^2. \tag{63}$$

The real and imaginary parts of the impedance measurement are assumed to have the same frequency-independent value for the standard deviation $\sigma$. Repeated measurements of the input impedance can be used to determine the standard deviation $\sigma$.

In the least squares method, fault monitor 400 varies the two fitting parameters, $L'$ and $\Gamma'$, to obtain a minimum value $\chi^2$ in equation (63). The resulting values for $L'$ and $\Gamma'$ are the most likely solutions given the measured data. However, since the functions $h'(\omega)$ and $h''(\omega)$ are periodic, there are many local minima, so the fault monitor 400 must select the correct minimum.

Equation (62) can also be fit using the least squares method by minimizing $$\chi^2 = \frac{1}{\sigma^2}\sum_{i=1}^{N}[g(\omega_i)-\zeta''(\omega_i)/\zeta'(\omega_i)]^2. \tag{64}$$

From the propagation of errors, the variance in the ratio, $R(\omega)\equiv\zeta''(\omega)/\zeta'(\omega)$, may be computed as:

$$\sigma_R^2 = \sigma^2\left(\frac{\partial R}{\partial \zeta'}\right)^2 + \sigma^2\left(\frac{\partial R}{\partial \zeta''}\right)^2 = \sigma^2\left(\frac{1}{\zeta'}\right)^2[1+R^2], \tag{65}$$

In block 1504, the fault monitor 400 determines a quality of fit for each function. The quality of fit of the impedance data to $h'(\omega)$ and $h''(\omega)$ can be determined from the variance per degree of freedom, $$\chi_D^2 = \frac{\chi^2}{2N-2}. \tag{66}$$

There are $\xi=2N-2$ degrees of freedom since there are 2N data points and there are two fitting parameters, $L'$ and $\Gamma'$. Generally when there are a large number of samples, there is a 50% probability that $\chi_\xi^2\geq 1$; a 10% probability that $\chi_\xi^2\geq 1.2$; and a miniscule probability that $\chi_\xi^2\geq 2$. Hence, if $\chi_\xi^2\geq 2$, it is likely that the functions with the chosen parameters do not fit the data.

For $g(\omega)$ the quality of fit can be determined as:

$$\chi_D^2 = \frac{\chi^2}{2N-2}. \tag{67}$$

In block 1506, the fault monitor 400 selects a distance value based on which of the various minima exhibit the best quality of fit (e.g., the lowest value of $\chi_\xi^2$).

The above discussion is meant to be illustrative of principles and various exemplary embodiments of the present invention. Numerous variations and modifications will become apparent to those skilled in the art once the above disclosure is fully appreciated. For example, while embodiments have been described with reference to locating a fault in wired drill pipes, those skilled in the art will understand that embodiments are applicable to locating faults in various communication systems that employ sections of bandwidth limited media.

What is claimed is:

1. A method for locating a fault in wired drill pipe, comprising:

measuring input impedance of wired drill pipes of a drill string while drilling a borehole, the drill string disposed in the borehole;

computing a first distance to a fault based on the fault being an open circuit;

computing a second distance to the fault based on the fault being a short circuit;

determining which of the first distance and the second distance provides a best estimate of a true distance to the fault.

2. The method of claim 1, wherein the determining comprises:

determining which of the first distance and the second distance has a smaller valued imaginary part; and selecting one of the first distance and the second distance having the smaller valued imaginary part to be the best estimate.

3. The method of claim 1, wherein the determining comprises:

determining which of the first distance and the second distance is more frequency independent; and selecting the more frequency independent of the first distance and the second distance to be the best estimate.

4. The method of claim 1, wherein computing the first distance and the second distance comprises selecting a value for a coefficient of $\pi$ in an imaginary part of a complex logarithm applied to determine each distance such that a real part of the distance is constant over frequency and an imaginary part of the distance is minimized over frequency.

5. The method of claim 1, further comprising averaging a plurality of best estimates distances to the fault determined for a number of different frequencies to determine a final distance to the fault.

6. The method of claim 1, further comprising:

computing standard deviation of an imaginary part of the best estimate over frequency; and accepting the best estimate as a final distance to the fault based on the imaginary part of the best estimate being within a predetermined range about zero within two standard deviations.

7. A method for locating a fault in wired drill pipe (WDP), comprising:

measuring input impedance of wired drill pipes of a drill string while drilling a borehole, the drill string disposed in the borehole;

identifying two adjacent zero crossings in WDP impedance values derived from the measured input impedance;

computing a distance to a fault in the WDP based on the two adjacent zero crossings.

8. The method of claim 7, wherein the WDP impedance values comprise an imaginary part of the measured input impedance.

9. The method of claim 7, wherein the WDP impedance values comprise a ratio of an imaginary part of the measured input impedance to a real part of the measured input impedance.

10. The method of claim 7, further comprising averaging a plurality of distances to the fault computed for a number of adjacent pairs of zero crossings to determine a final distance to the fault.

11. A method for locating a fault in wired drill pipe (WDP), comprising:

measuring input impedance of wired drill pipes of a drill string while drilling a borehole, the drill string disposed in the borehole;

fitting WDP impedance values derived from the measured input impedance to an input impedance function;

determining a distance to a fault in the WDP based on a distance value and a reflection coefficient that best fit the WDP impedance values to the input impedance function.

12. The method of claim 11, wherein the WDP impedance values comprise:

a real part of the measured input impedance, and an imaginary part of the measured input impedance; and wherein the fitting comprises:

fitting the real part of the measured input impedance to a first function, and fitting the imaginary part of the measured input impedance to a second function.

13. The method of claim 11, wherein the WDP impedance values comprise a ratio of an imaginary part of the measured input impedance to a real part of the measured input impedance.

14. The method of claim 11, wherein the fitting comprising minimizing the accumulated squared difference of the WDP impedance values and the input impedance function.

15. The method of claim 14, further comprising:

computing a quality of fit value for each of a plurality of minima identified by the minimizing; and wherein determining the distance comprises selecting the distance to the fault in accordance with the distance value and the reflection coefficient that generated the minimum producing a best quality of fit value.

16. Apparatus for drilling a borehole in formations, comprising:

a drill string comprising a plurality of wired drill pipes, each wired drill pipe comprising an inductive coupler at each terminal end; and a wired drill pipe fault monitor coupled to the wired drill pipes, the fault monitor comprising:

an impedance measuring system configured to measure, while drilling the borehole, an input impedance of the wired drill pipes; and a fault locator configured to:

determine a propagation constant for the wired drill pipes; and analyze the measured input impedance and determine, as a function of the measured input impedance and the propagation constant, a location of a fault in the wired drill pipes.

17. The apparatus of claim 16, wherein the fault locator is configured to:

compute a first distance to a fault based on the fault being an open circuit;

compute a second distance to the fault based on the fault being a short circuit; and determine which of the first distance and the second distance provides a best estimate of a true distance to the fault.

18. The apparatus of claim 17, wherein the fault locator is configured to:

determine which of the first distance and the second distance has a smaller valued imaginary part; and select one of the first distance and the second distance having the smaller valued imaginary part to be the best estimate.

19. The apparatus of claim 17, wherein the fault locator is configured to:

determine which of the first distance and the second distance is less frequency dependent; and select the less frequency dependent of the first distance and the second distance to be the best estimate.

20. The apparatus of claim 17, wherein the fault locator is configured to select a value for a coefficient of $\pi$ in an imaginary part of a complex logarithm applied to determine each distance such that variation of a real part of the distance is minimized over frequency and values an imaginary part of the distance are minimized over frequency.

21. The apparatus of claim 17, wherein the fault locator is configured to average a plurality of best estimates distances to the fault determined for a number of different frequencies to determine a final distance to the fault.

22. The apparatus of claim 17, wherein the fault locator is configured to:

compute standard deviation of an imaginary part of the best estimate over frequency; and accept the best estimate as a final distance to the fault based on the imaginary part of the best estimate being within a predetermined range about zero within two standard deviations.

23. The apparatus of claim 16, wherein the fault locator is configured to:

identify two adjacent zero crossings in WDP impedance values derived from the measured input impedance;

compute a distance to a fault in the WDP based on the two adjacent zero crossings.

24. The apparatus of claim 23, wherein the WDP impedance values comprise at least one of an imaginary part of the measured input impedance, and a ratio of the imaginary part of the measured WDP input impedance to a real part of the measured WDP input impedance.

25. The apparatus of claim 23, wherein the fault locator is configured to average a plurality of distances to the fault computed for a plurality of adjacent pairs of zero crossings to determine a final distance to the fault.

26. The apparatus of claim 16, wherein the fault locator is configured to:

fit WDP impedance values derived from the measured input impedance to an input impedance function; and determine a distance to a fault in the WDP based on a distance value and a reflection coefficient that best fit the WDP impedance values to the input impedance function.

27. The apparatus of claim 26, wherein the WDP impedance values comprise:

a real part of the measured input impedance, and an imaginary part of the measured input impedance; and wherein the fault locator is configured to:

fit the real part of the measured input impedance to a first function, and fit the imaginary part of the measured input impedance to a second function.

28. The apparatus of claim 26, wherein the WDP impedance values comprise a ratio of an imaginary part of the measured input impedance to a real part of the measured input impedance.

29. The apparatus of claim 26, wherein the fault locator is configured to minimize the accumulated squared difference of the WDP impedance values and the input impedance function.

30. The apparatus of claim 29, wherein the fault locator is configured to:

compute a quality of fit value for each of a plurality of minima identified while fitting the WDP impedance values to the input impedance function; and determine distance to the fault based on the distance value and the reflection coefficient that generated the minimum producing a best quality of fit value.

31. The apparatus of claim 16, wherein the impedance measuring system is configured to:

measure the input impedance at a location downhole of the fault;

store the input impedance for use when the impedance measuring system is extracted from the borehole; and wherein the fault locator is configured to determine the location of the fault based on the input impedance measured from downhole of the fault after the impedance measuring system is extracted from the borehole.

32. A telemetry system, comprising:

a telemetry medium comprising a plurality of sections, each of the sections comprising:

an electrical conductor; and an inductive coupler connected to each end of the conductor that inductively couples the section to another of the sections; and a fault monitor coupled to the telemetry medium, the fault monitor comprising:

an impedance measuring system configured to measure an input impedance of the telemetry medium; and a fault locator configured to:

determine a propagation constant for the telemetry medium; and analyze the measured input impedance and determine, as a function of the measured input impedance and the propagation constant, a location of a fault in the telemetry medium.

33. The system of claim 32, wherein the fault locator is configured to:

compute a first distance to a fault based on the fault being an open circuit;

compute a second distance to the fault based on the fault being a short circuit; and select one of the first distance and the second distance as providing a best estimate of a true distance from the fault locator to the fault based on which of the first distance and the second distance has a smaller valued imaginary part.

34. The system of claim 33, wherein the fault locator is configured to select a value for a coefficient of $\pi$ in an imaginary part of a complex logarithm applied to determine each distance such that variation of a real part of the distance is minimized over frequency and values an imaginary part of the distance are minimized over frequency.

35. The system of claim 32, wherein the fault locator is configured to:

identify two adjacent zero crossings in telemetry medium impedance values derived from the measured input impedance;

compute a distance to a fault in the telemetry medium based on the two adjacent zero crossings.

36. The apparatus of claim 23, wherein the fault locator is configured to compute the distance based on difference of ratios of frequency to phase velocity at the two adjacent zero crossings.

* * * * *